US012416204B2

(12) United States Patent
Corona et al.

(10) Patent No.: US 12,416,204 B2
(45) Date of Patent: Sep. 16, 2025

(54) DRILL BITS HAVING REINFORCED FACE

(71) Applicant: BOART LONGYEAR MANUFACTURING AND DISTRIBUTION INC., Salt Lake City, UT (US)

(72) Inventors: Robert Andrew Corona, Salt Lake City, UT (US); Kiana Wright, Salt Lake City, UT (US)

(73) Assignee: Boart Longyear Manufacturing And Distribution Inc., Salt Lake City, UT (US)

( * ) Notice: Subject to any disclaimer, the term of this patent is extended or adjusted under 35 U.S.C. 154(b) by 0 days.

(21) Appl. No.: 18/270,311

(22) PCT Filed: Dec. 21, 2021

(86) PCT No.: PCT/US2021/064596

§ 371 (c)(1),
(2) Date: Jun. 29, 2023

(87) PCT Pub. No.: WO2022/146782

PCT Pub. Date: Jul. 7, 2022

(65) Prior Publication Data

US 2024/0052707 A1 Feb. 15, 2024

Related U.S. Application Data

(60) Provisional application No. 63/131,602, filed on Dec. 29, 2020.

(51) Int. Cl.

| | |
|---|---|
| ***E21B 10/54*** | (2006.01) |
| ***E21B 10/43*** | (2006.01) |
| ***E21B 10/56*** | (2006.01) |
| ***E21B 10/60*** | (2006.01) |

(52) U.S. Cl.

CPC ..... *E21B 10/54* (2013.01); *E21B 10/43* (2013.01); *E21B 10/56* (2013.01); *E21B 10/60* (2013.01)

(58) Field of Classification Search

CPC ..... E21B 10/54; E21B 10/43; E21B 10/56; E21B 10/60; E21B 10/42

See application file for complete search history.

(56) References Cited

U.S. PATENT DOCUMENTS 3,140,748 A * 7/1964 Engle ..... E21B 10/56 175/426
3,692,127 A * 9/1972 Hampe ..... E21B 10/48 175/405.1
4,128,136 A * 12/1978 Generoux ..... E21B 10/48 175/379

(Continued)

FOREIGN PATENT DOCUMENTS

GB 2362903 5/2000

*Primary Examiner* — Steven A MacDonald
(74) *Attorney, Agent, or Firm* — Ballard Spahr LLP

(57) ABSTRACT

A drill bit for cutting a hole in a formation can have a longitudinal axis extending along a center of the drill bit. The drill bit can comprise a crown comprising at least one crown portion having a cutting face. A plurality of wear-resistant members can be embedded in the crown of the drill bit, wherein at least one wear-resistant member of the plurality of wear-resistant members extends to within 0.1 inches of the cutting face of the at least one crown portion.

18 Claims, 20 Drawing Sheets

(56) References Cited

U.S. PATENT DOCUMENTS 4,189,015 A * 2/1980 Acker, III ..... B28D 1/041 175/402
4,190,126 A * 2/1980 Kabashima ..... E21B 10/5673 175/379
4,499,959 A * 2/1985 Grappendorf ..... E21B 10/5673 175/405.1
6,298,930 B1 10/2001 Sinor et al.
6,349,780 B1 * 2/2002 Beuershausen ..... E21B 10/46 175/431
8,991,524 B2 3/2015 Pearce et al.
10,077,609 B2 * 9/2018 Pearce ..... E21B 10/602
10,626,676 B1 * 4/2020 Drenth ..... E21B 10/00
2005/0105977 A1 * 5/2005 Ishihara ..... B23B 51/06 408/1 R
2007/0205024 A1 9/2007 Mensa-Wilmot
2007/0246266 A1 * 10/2007 Larbo ..... E21B 10/02 175/434
2008/0283305 A1 11/2008 Overstreet et al.
2010/0089660 A1 * 4/2010 Pearce ..... E21B 10/48 175/403
2011/0000715 A1 * 1/2011 Lyons ..... E21B 10/46 175/428
2011/0042148 A1 2/2011 Schmitz et al.
2013/0186693 A1 * 7/2013 West ..... E21B 10/02 175/332
2015/0136493 A1 * 5/2015 Pearce ..... E21B 10/60 175/428
2015/0136494 A1 * 5/2015 Pearce ..... E21B 10/54 175/428
2016/0053547 A1 * 2/2016 Samuel ..... E21B 7/24 175/57
2016/0201398 A1 7/2016 Pearce et al.
2016/0312538 A1 10/2016 Marley et al.
2017/0362900 A1 * 12/2017 Pearce ..... E21B 10/61
2018/0202235 A1 * 7/2018 Richert ..... E21B 10/602
2018/0243819 A1 * 8/2018 Oxford ..... E21B 10/42

* cited by examiner

DRILL BITS HAVING REINFORCED FACE

CROSS-REFERENCE TO RELATED APPLICATION

This application is a national phase filing under 35 U.S.C. § 371 of International Application No. PCT/US2021/064596, filed Dec. 21, 2021, which claims priority to and the benefit of U.S. Provisional Application No. 63/131,602, filed Dec. 29, 2020, which applications are incorporated herein by reference in their entirety.

FIELD

This application relates to drill bits for cutting a hole in a formation, and, more particularly, to drill bits having one or more wear-resistant members that reinforce the face of the bit.

BACKGROUND

Existing drill bits have a cutting face that is configured to bore into a formation (e.g., a rock formation). In some circumstances, bits can have a base surface that is proximally spaced from the cutting face and axially extending walls extend between the base surface and the cutting face. Some conventional bits have wear-resistant members that are configured to protect the bit from cuttings wearing away at the axially extending walls. However, because the wear resistant members are known to inhibit cutting efficiency of the bit, the wear-resistant members do not extend to the cutting face.

Thus, there is a need in the pertinent art for drill bits that more effectively provide high-velocity fluid flow to the cutting surface of the bit and remove heat from the cutting surface. There is a further need in the pertinent art for drill bits that provide increased cutting removal rates and penetration rates in comparison to conventional drill bits.

SUMMARY

Disclosed herein, in one aspect, is a drill bit for cutting a hole in a formation. The drill bit can have a longitudinal axis extending along a center of the drill bit. The drill bit can comprise a crown comprising at least one crown portion having a cutting face. A plurality of wear-resistant members can be embedded in the crown of the drill bit, wherein at least one wear-resistant member of the plurality of wear-resistant members extends to within 0.1 inches of the cutting face of the at least one crown portion.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE FIGURES

These and other features of the preferred embodiments of the invention will become more apparent in the detailed description in which reference is made to the appended drawings wherein.

DETAILED DESCRIPTION

Figure 1:
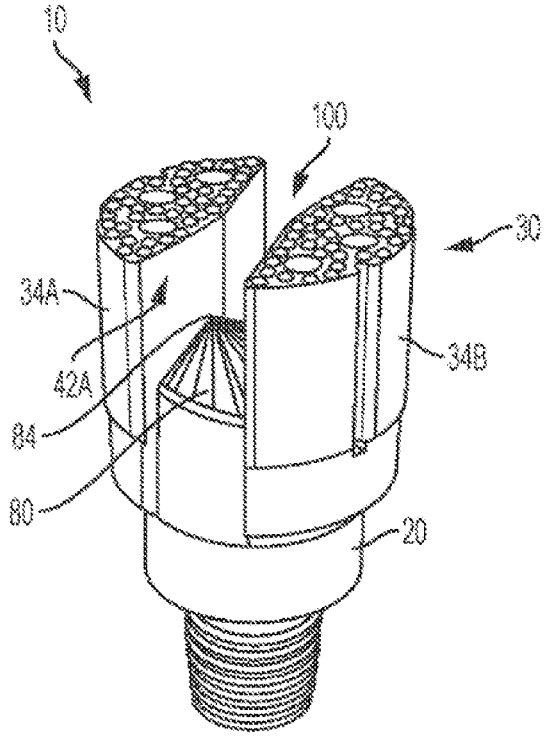
FIG. 1 is a top perspective view of an exemplary drill bit having two crown portions as disclosed herein, taken from a first side of the drill bit.
Figure 2:
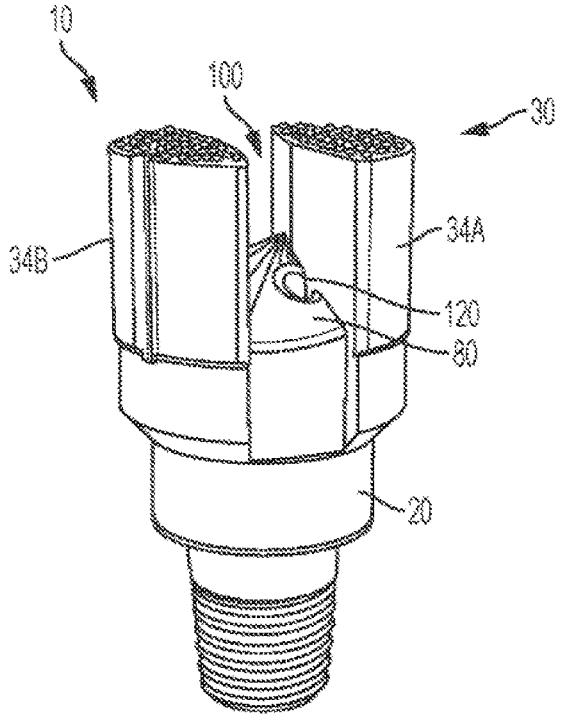
FIG. 2 is a top perspective view of the drill bit of FIG. 1, taken from an opposed side of the drill bit.

The present invention can be understood more readily by reference to the following detailed description, examples, drawings, and claims, and their previous and following descriptions. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a bore" can include two or more such bores unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Similarly, in some optional aspects, when values are approximated by use of the terms "approximately," "substantially," or "generally," it is contemplated that values within up to 15%, up to 10%, up to 5%, or up to 1% (above or below) of the particular value can be included within the scope of those aspects. When used with respect to an identified property or circumstance, "substantially" or "generally" can refer to a degree of deviation that is sufficiently small so as to not measurably detract from the identified property or circumstance, and the exact degree of deviation allowable may in some cases depend on the specific context. Likewise, "substantially parallel" can optionally be understood to mean within 10 degrees of, within 5 degrees of, or within 1 degree of (plus or minus).

As used herein, the term "proximal" refers to a direction toward the surface of a formation (where a drill rig can be located), whereas the term "distal" refers to a direction toward the bottom or end of a drill hole, moving away from the surface of the formation. When the terms "proximal" and "distal" are used to describe system components, it is expected that during normal use of those components, the "proximal" components will be positioned proximally (closer to the surface of the formation) relative to the "distal" components and the "distal" components will be positioned distally (closer to the bottom of a drill hole) relative to the "proximal" components.

As used herein, the terms "optional" or "optionally" mean that the subsequently described event or circumstance may or may not occur, and that the description includes instances where said event or circumstance occurs and instances where it does not.

The word "or" as used herein means any one member of a particular list and, except where the context indicates otherwise, can also include any combination of members of that list.

Described herein with reference to FIGS. 1-26 is a drill bit 10, 200 for cutting a hole in a formation. The drill bit 10, 200 has a longitudinal axis 12, 202. In exemplary aspects, the drill bit 10, 200 can comprise a shank 20, 220 and a crown 30, 230. In this aspect, the crown 30, 230 has an operative circumference 32, 232. It is contemplated that the drill bits disclosed herein can provide an improved penetration rate relative to conventional drill bits. It is further contemplated that the drill bits disclosed herein can provide enhanced chip/cutting removal and enhanced cooling of the cutting face of the bit, as measured relative to conventional drill bits. It is still further contemplated that the drill bits disclosed herein can provide improved wear resistance relative to conventional drill bits. In exemplary aspects, the drill bit 10, 200 can be a full face drill bit, such as, for example, a full face core drill bit. It is contemplated that the full face drill bits disclosed herein can be used in conditions when a core sample is not required.

In use, the drill bit 10, 200 can be configured to channel and fracture a micro-core from the center of the drill bit and direct and/or flush the fractured micro-core to the outer diameter of the drill bit. Complementarily, this exemplary configuration allows for reduced wear of the inner diameter of the drill bit, which is the typical wear mode of conventional full face bits. Further, the exemplary full face drill bit can increase the rate of penetration in comparison to conventional full face bits that, due to their intrinsic design limitations, have a limited ability to cut at the center of the full face bit as a result of the very low surface velocities.

One skilled in the art will appreciate that conventional full face bits typically wear from the center of the upper contact face of the drill bit as a result of low cutting velocity and poor chip flushing. This design failure mode is exacerbated as the rock being drilled increases in hardness. The cycle of wear in the center of a full face bit leads to further reduced flushing in the center, which in-turn causes more wear, drastically limiting the potential life of full face bits when compared to coring bits. In the past, bit designs have attempted to overcome this design failure mode by adding one or more of a center port and/or waterways that are distributed on the bit or by reinforcing the center port waterway to reduce the wear rate at the center of the bit.

In exemplary aspects, the disclosed drill bits 10, 200 can comprise a plurality of crown portions spaced apart relative to the operative circumference 32, 232 of the crown 30, 230. In these aspects, and as further disclosed herein, it is contemplated that each crown portion of the plurality of crown portions can have a first longitudinal edge, a second longitudinal edge, an outer surface, at least one inner surface, and a cutting face. The outer surface extends between the first longitudinal edge and the second longitudinal edge and defines a portion of the operative circumference of the crown. In combination, the at least one inner surface extends from the first longitudinal edge to the second longitudinal edge. In further aspects, the drill bit 10, 200 can comprise a base surface 80, 280 spaced from the cutting faces of the plurality of crown portions relative to the longitudinal axis 12, 202 of the drill bit. As further disclosed herein, the base surface 80, 280 of the drill bit 10, 200 can cooperate with the inner surfaces of the plurality of crown portions to define a slot 100, 300. As further disclosed herein, the crown 30, 230 and the shank 20, 220 can cooperate to define an interior space about the longitudinal axis 12, 202.

As further disclosed herein, the base surface 80, 280 of the drill bit can have an apex 84, 284 that is spaced from a center point 18, 210 of the drill bit and positioned within a portion of the slot 100, 300 that is outwardly tapered as it moves toward the outer diameter of the drill bit. In operation, it is contemplated that the inner surfaces of each crown portion can define a leading portion and a trailing portion, with at least the trailing portion being outwardly tapered moving away from the center 18, 210 of the drill bit and toward the outer diameter of the drill bit. It is further contemplated that the outward tapering of the trailing portions of the crown portions can create additional relief in the dispersal of cuttings during rotation of the drill bit.

Optionally, the plurality of crown portions can comprise at least two crown portions. In exemplary aspects, the plurality of crown portions can optionally comprise at least three crown portions. In further exemplary aspects, the plurality of crown portions can optionally comprise at least four crown portions. However, it is contemplated that the plurality of crown portions can comprise any selected number of crown portions.

Drill Bits Having Two Crown Portions

In exemplary aspects, and with reference to FIGS. 1-14 and 22-23, the drill bits disclosed herein can have a first crown portion 34A and a second crown portion 34B. In these aspects, it is contemplated that the drill bits disclosed herein can be plug and/or non-coring bits. In still further exemplary aspects, it is contemplated that the drill bits disclosed herein can be concave-faced drill bits. In still further exemplary aspects, it is contemplated that the drill bits disclosed herein can be non-concave faced drill bits.

Figure 7:
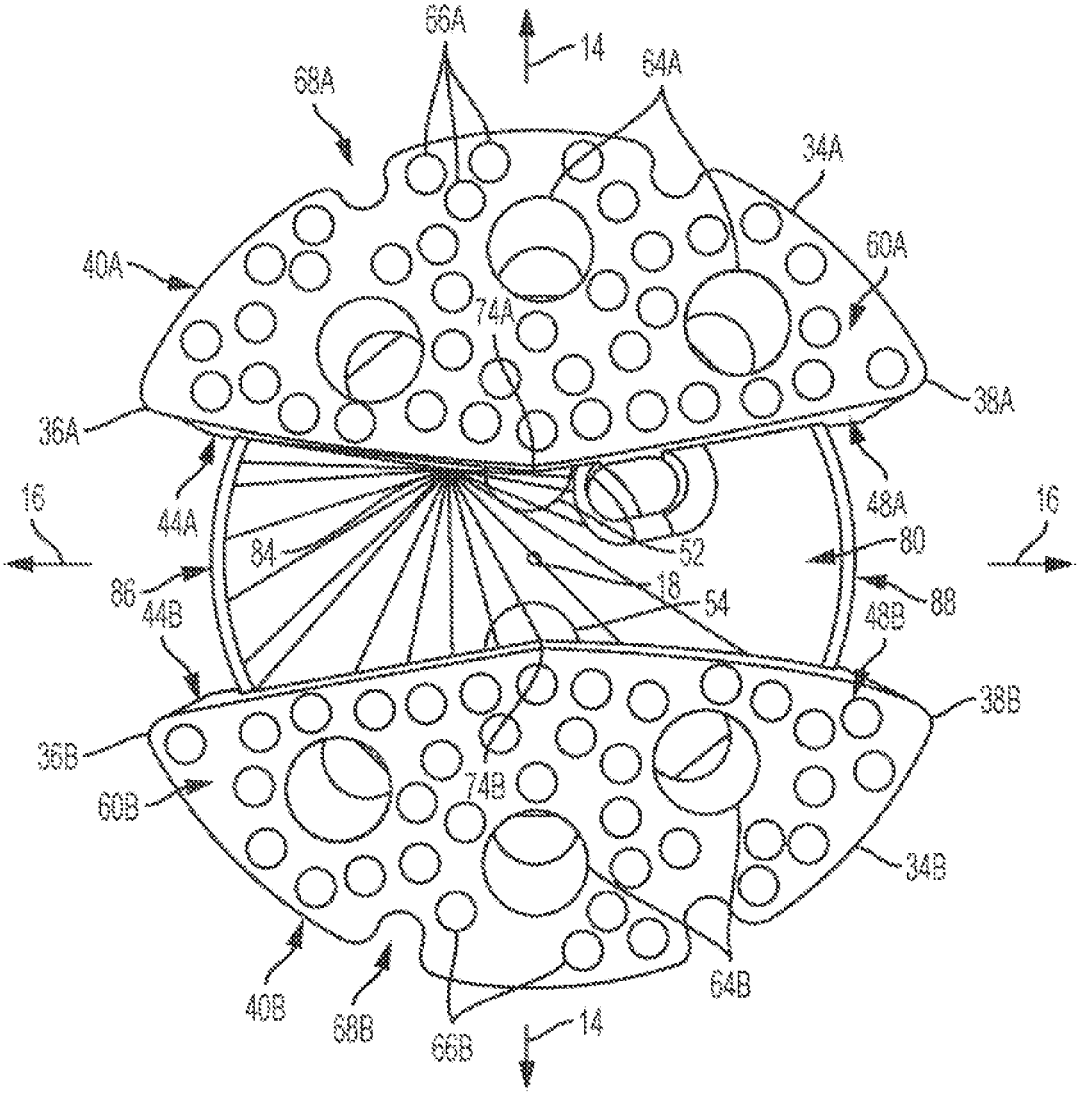
FIG. 7 depicts a top view of the drill bit of FIG. 1.
Figure 8:
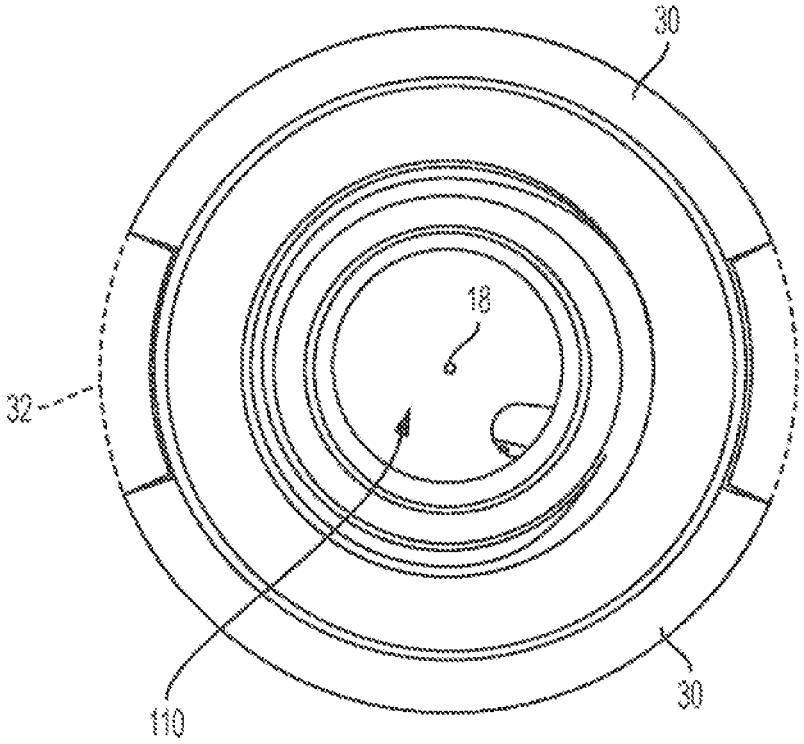
FIG. 8 depicts a bottom view of the drill bit of FIG. 1.

In one aspect, the first crown portion 34A and the second crown portion 34B can be spaced apart relative to a first transverse axis 14 that is perpendicular to the longitudinal axis 12. In a further aspect, each of the first and second crown portions 34A, 34B can comprise a first longitudinal edge 36A, 36B, a second longitudinal edge 38A, 38B, an outer surface 40A, 40B, at least one inner surface 42A, 42B, and a cutting face 60A, 60B. In this aspect, the outer surface 40A, 40B can extend between the first longitudinal edge 36A, 36B and the second longitudinal edge 38A, 38B. As shown in FIGS. 7-8, the outer surface 40A, 40B can define a portion of the operative circumference 32 of the crown 30. In another aspect, the at least one inner surface 42A, 42B of each of the first and second crown portions 34A, 34B can extend from the first longitudinal edge 36A, 36B to the second longitudinal edge 48A, 48B of the crown portion. Optionally, in exemplary aspects, the radial distance from the center 18 of the bit to the outer surfaces 40A, 40B of the crown portions 34A, 34B can range from about 0.625 inches to about 6.25 inches.

Optionally, in exemplary aspects, the at least one inner surface 42A, 42B of the first and second crown portions 34A, 34B can comprise a plurality of inner surfaces. In one aspect, each of the first and second crown portions 34A, 34B can respectively have a first inner surface 44A, 44B, a second inner surface 48A, 48B, and a longitudinal medial edge 74A, 74B. In one aspect, the first inner surface 44A, 44B can extend from the first longitudinal edge 36A, 36B of the crown portion 34A, 34B to the longitudinal medial edge 74A, 74B of the crown portion 34A, 34B. In this aspect, the second inner surface 48A, 48B can extend from the second longitudinal edge 38A, 38B of the crown portion to the longitudinal medial edge 74A, 74B. Optionally, in exemplary aspects, the longitudinal medial edges 74A, 74B of the first and second crown portions 34A, 34B can be positioned on opposed sides of the first transverse axis 14, which passes through the center 18 of the drill bit.

In additional optional aspects, the second inner surface 48A, 48B of each of the first and second crown portions 34A, 34B is substantially flat. Alternatively, in other optional aspects, and with reference to FIGS. 11-14, at least a portion of the second inner surface 48A, 48B of the first and second crown portions 34A, 34B can be curved. In these aspects, it is contemplated that the second inner surface 48A, 48B of at least one of or both of the first and second crown portions 34A, 34B can taper away from a second transverse axis 16 that is perpendicular to the longitudinal axis 12 and the first transverse axis 14, moving from the longitudinal medial edge 74A, 74B to the second edge 38A, 38B of the crown portion. It is further contemplated that the curve can have any desired curvature profile, such as, for example and without limitation, a convex curve, a concave curve, a serpentine pattern, and the like. Optionally, in exemplary aspects, it is further contemplated that the second inner surface 48A, 48B of each of the first and second crown portions 34A, 34B can have a first portion 49A, 49B proximate the longitudinal medial edge 74A, 74B. In these aspects, the second inner surface 48A, 48B of each of the first and second crown portions 34A, 34B can have a second portion 51A, 51B extending from the first portion 49A, 49B to the second edge 38A, 38B of the crown portion. In exemplary aspects, the first portion 49A, 49B can have a greater radius of curvature than the second portion 51A, 51B. Optionally, however, it is contemplated that the first and second portions can have substantially equal radii of curvature. Optionally, it is further contemplated that the second portion 51A, 51B can have a greater radius of curvature than the first portion 49A, 49B.

In further exemplary aspects, the first edges 36A, 36B of the first and second crown portions 34A, 34B can be spaced apart by a first distance relative to the first transverse axis 14, and the second edges 38A, 38B of the first and second crown portions 34A, 34B can be spaced apart by a second distance relative to the first transverse axis 14. In exemplary aspects, the first and second distances can range from about 0.125 inches to about 1 inch. Optionally, in these aspects, the second distance can be greater than the first distance. In additional optional aspects, it is contemplated that at least a portion of the first inner surface 44A, 44B of each of the first and second crown portions 34A, 34B can be substantially flat. In these aspects, the first inner surface 44A, 44B of each of the first and second crown portions 34A, 34B can be angled away from the second transverse axis 16. Optionally, in further exemplary aspects, it is contemplated that at least a portion of the first inner surface 44A, 44B of each of the first and second crown portions 34A, 34B can be curved. In these aspects, it is contemplated that the curve can have any desired curvature profile, such as, for example and without limitation, a convex curve, a concave curve, a serpentine pattern, and the like.

Figure 14:
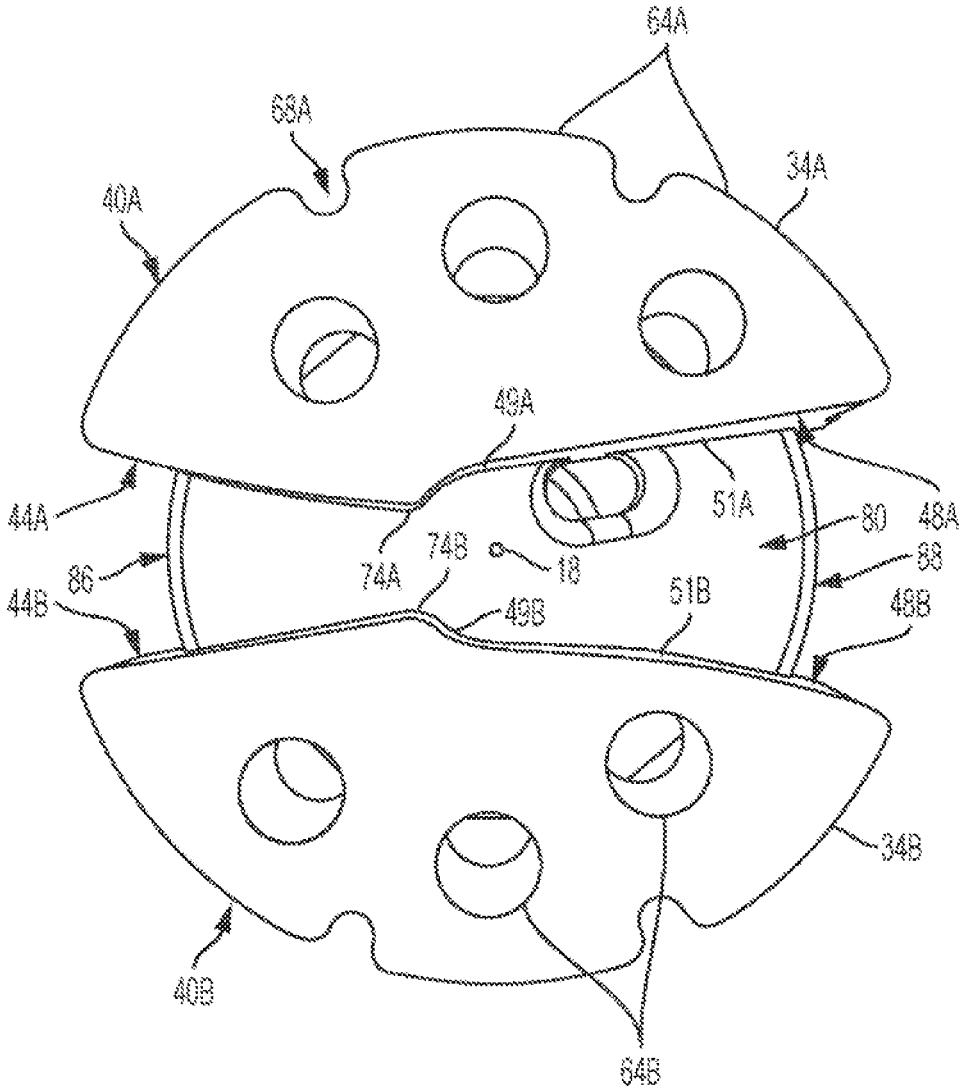
FIG. 14 is a top view of the drill bit of FIG. 11.
Figure 15:
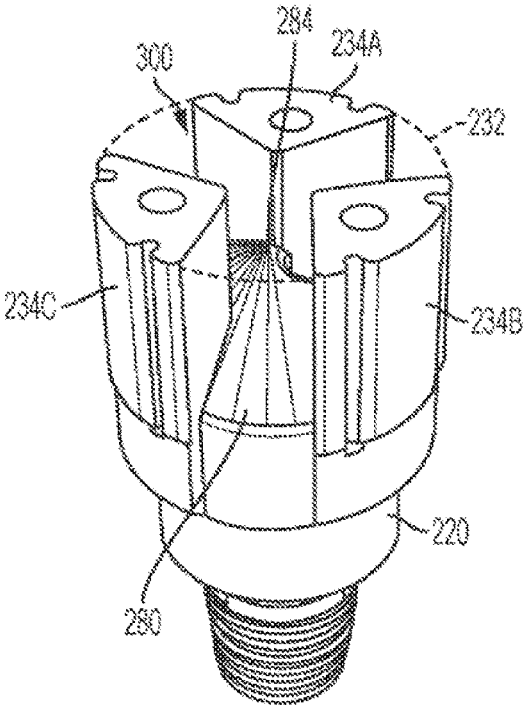
FIG. 15 is top perspective view of an exemplary drill bit having three crown portions as disclosed herein.
Figure 16:
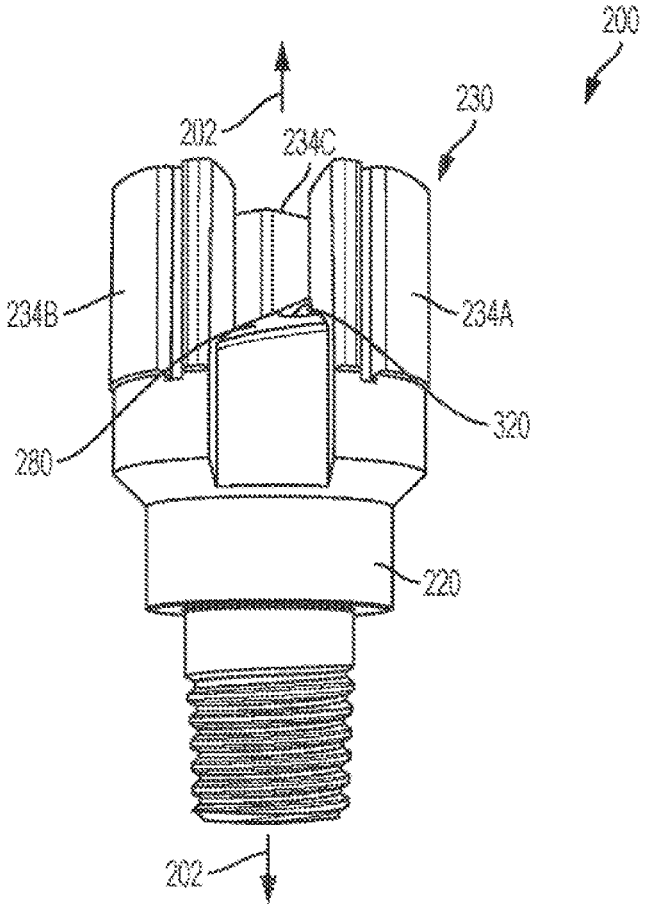
FIG. 16 is a first side view of the drill bit of FIG. 15, showing a first slot portion defined by first and second crown portions of the bit.
Figure 17:
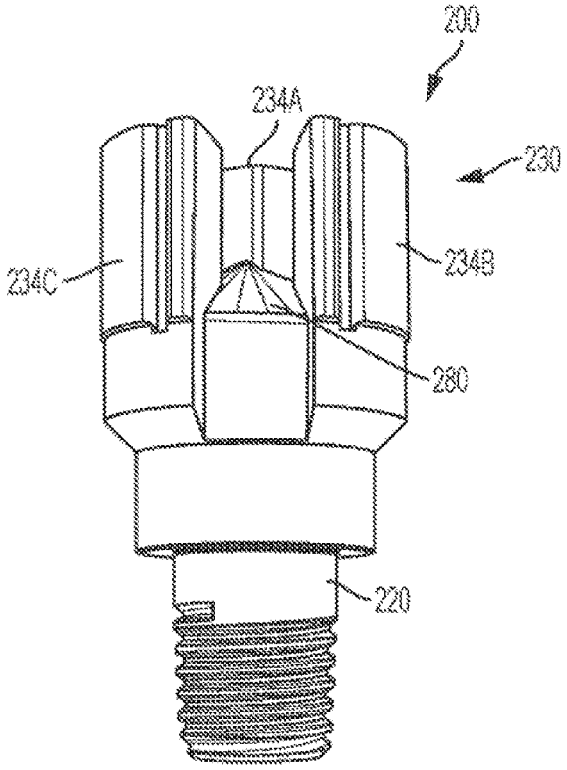
FIG. 17 is a second side view of the drill bit of FIG. 15, showing a second slot portion defined by second and third crown portions of the bit.

As one will appreciate, and with reference to FIGS. 7 and 14, during normal rotation of the drill bit 10, the first inner surface 44A of the first crown portion 34A and the second inner surface 48B of the second crown portion 34B can serve as the leading edges of the drill bit, with the second inner surface 48A of the first crown portion and the first inner surface 44B of the second crown portion serving as the trailing edges of the drill bit. However, it is contemplated that the direction of rotation of the drill bit can be reversed, such that the second inner surface 48A of the first crown portion 34A and the first inner surface 44B of the second crown portion 34B serve as the leading edges of the drill bit, with the first inner surface 44A of the first crown portion and the second inner surface 48B of the second crown portion serving as the trailing edges of the drill bit.

In exemplary aspects, the first inner surface 44A and the second inner surface 48A of the first crown portion 34A can be angularly oriented relative to each other at a first desired angle 52. In these aspects, the first inner surface 44B and the second inner surface 48B of the second crown portion 34B can be angularly oriented relative to each other at a second desired angle 54. It is contemplated that the first desired angle 52 can be substantially equal to the second desired angle 54. Alternatively, it is contemplated that the first desired angle 52 can be different than the second desired angle 54. The first desired angle 52 can range from about 30° to about 330°, preferably range from about 135° to about 225°, and more preferably be about 200°. The second desired angle 54 can range from about 30° to about 330°, preferably range from about 135° to about 225°, and more preferably be about 200°.

In one aspect, the first inner surfaces 44A, 44B of the first and second crown portions 34A, 34B have respective lengths that correspond to the distance between the first longitudinal edge 36A, 36B and the longitudinal medial edge 74A, 74B of each crown portion. Optionally, in exemplary aspects, the length of the first inner surface 44A of the first crown portion 34A does not equal the length of the first inner surface 44B of the second crown portion 34B. However, it is contemplated that the lengths of the first inner surfaces 44A, 44B can optionally be substantially equal. In other aspects, the second inner surfaces 48A, 48B of the first and second crown portions 34A, 34B have respective lengths that correspond to the distance between the second longitudinal edge 38A, 38B and the longitudinal medial edge 74A, 74B of the crown portion 34A, 34B. Optionally, in exemplary aspects, the length of the second inner surface 48A of the first crown portion 34A does not equal the length of the second inner surface 48B of the second crown portion 34B. However, it is contemplated that the lengths of the second inner surfaces 48A, 48B can optionally be substantially equal.

In one exemplary aspect, the length of the first inner surface 44A of the first crown portion 34A does not equal the length of the second inner surface 48A of the first crown portion 34A. In another exemplary aspect, the length of the first inner surface 44B of the second crown portion 34B does not equal the length of the second inner surface 48B of the second crown portion 34B. Optionally, in a further exemplary aspect, the length of the first inner surface 44A of the first crown portion 34A does not equal the length of the second inner surface 48A of the first crown portion 34A, and the length of the first inner surface 44B of the second crown portion 34B does not equal the length of the second inner surface 48B of the second crown portion 34B.

Figure 3:
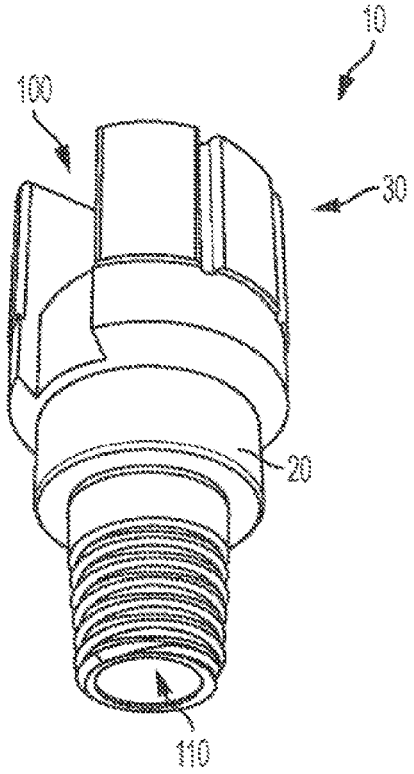
FIG. 3 is a bottom perspective view of the drill bit of FIG. 1.
Figure 4:
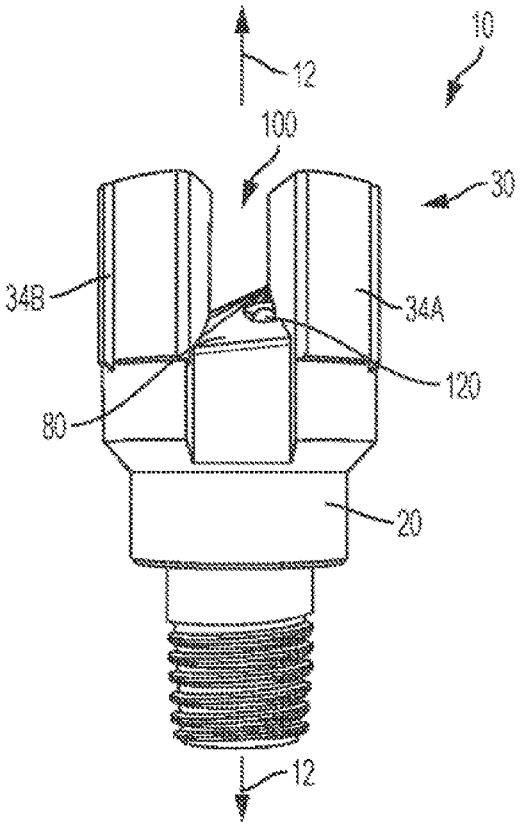
FIG. 4 is a front side view of the drill bit of FIG. 1, showing the slot defined by the base surface and the first and second crown portions as disclosed herein.
Figure 5:
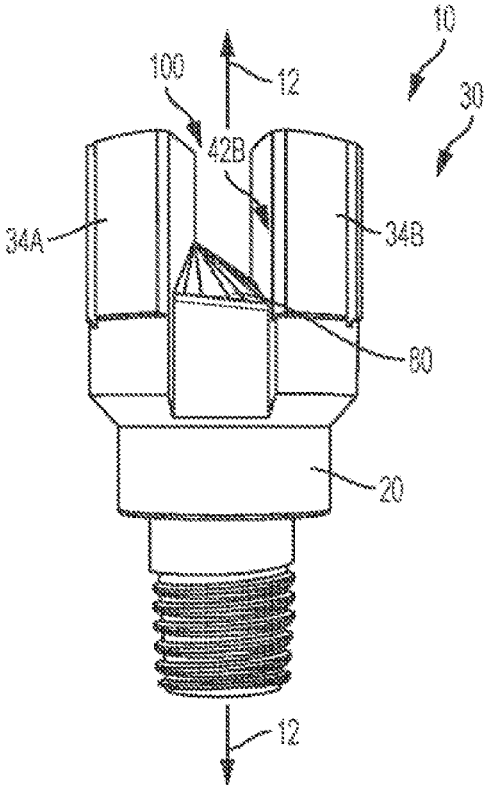
FIG. 5 is a back side view of the drill bit of FIG. 1.
Figure 6:
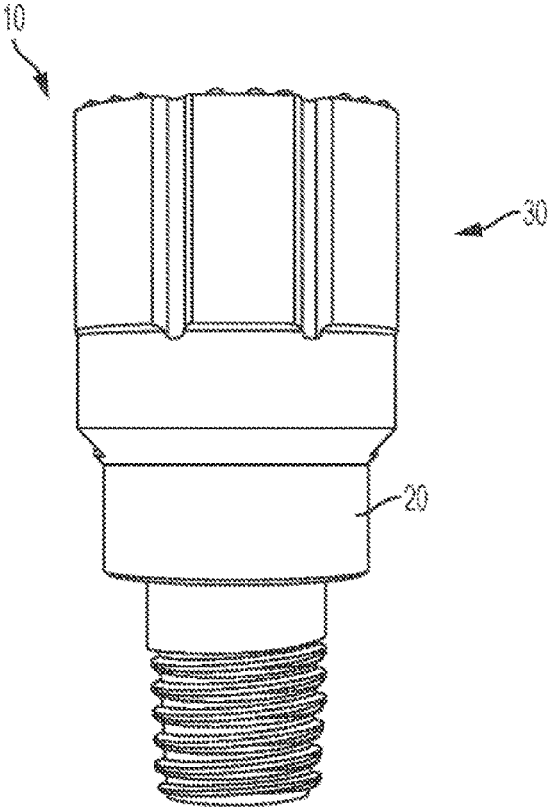
FIG. 6 depicts a left or right side view of the drill bit of FIG. 1.

In one aspect, the cutting faces 60A, 60B of the first and second crown portions 34A, 34B have respective heights relative to the longitudinal axis 12 of the drill bit 10. Optionally, in some exemplary aspects, the height of the cutting face 60A of the first crown portion 34A can be substantially equal to the height of the cutting face 60B of the second crown portion 34B. However, it is contemplated that the heights of the cutting faces 60A, 60B can optionally be different from one another. As shown in FIGS. 3 and 8, it is contemplated that the crown portions 34A, 34B and the shank 20 can cooperate to define an interior space 110 about the longitudinal axis 12. It is further contemplated that the interior space 110 can be configured to receive water or other drilling fluid during use of the drill bit 10. In one aspect, the water or other drilling fluid can be supplied to the interior space 110 at a desired pressure using conventional means.

In another aspect, each of the first and second crown portions 34A, 34B can define a plurality of bores 64A, 64B extending from the cutting faces 60A, 60B to the interior space 110. In this aspect, it is contemplated that the plurality of bores 64A, 64B can be configured to direct water (or other drilling fluid) substantially directly to the cutting faces 60A, 60B from the interior space 110. This direct supply of drilling fluid to the cutting faces 60A, 60B is distinguishable from the supply of fluid by ports within junk slots that are recessed relative to a cutting face. It is further contemplated that the direct supply of pressurized water (or other drilling fluid) to the cutting faces 60A, 60B can increase flow velocity across the cutting faces, thereby permitting more rapid removal of cuttings and significantly increasing the convective cooling of the cutting face. It is further contemplated that the plurality of bores 64A, 64B can reduce the combined contact area of the cutting faces 60A, 60B relative to the total area of cutting faces of conventional drill bits, thereby improving the penetration rate of the drill bit 10. It is still further contemplated that the plurality of bores 64A, 64B can permit novel distribution of water (or other drilling fluid) relative to the cutting faces 60A, 60B, thereby improving the wear resistance of the drill bit 10. It is still further contemplated that the plurality of bores 64A, 64B can provide flexibility in the distribution of water (or other drilling fluid) such that the center port of conventional drill bits is unnecessary (and can be eliminated from the drill bit). Optionally, in some aspects, it is contemplated that the cutting faces 60A, 60B can have a convex profile. In other aspects, it is contemplated that the cutting faces 60A, 60B can optionally have a concave profile.

In exemplary aspects, the plurality of bores 64A, 64B can optionally be substantially equally distributed about the cutting faces 60A, 60B. Optionally, in some aspects, the plurality of bores 64A, 64B can be randomly spaced about each of the first and second crown portions 34A, 34B. In other aspects, the plurality of bores 64A, 64B can optionally be substantially uniformly spaced about the cutting faces 60A, 60B. In these aspects, it is contemplated that at least two concentric rows of bores can be provided, with the bores in each respective row being substantially uniformly spaced about the cutting faces 60A, 60B.

More generally, it is contemplated that the plurality of bores 64A, 64B can be provided in any selected configuration. It is further contemplated that the plurality of bores 64A, 64B can be distributed so as to optimize the wear characteristics of the drill bit 10 for a particular application.

It is contemplated that each bore of the plurality of bores 64A, 64B can be provided in a selected shape. In exemplary aspects, the plurality of bores 64A, 64B can have a substantially cylindrical shape (with substantially circular cross-sectional profile). However, it is contemplated that the plurality of bores 64A, 64B can have any shape, including, for example and without limitation, a substantially conical (tapered) shape (with a substantially circular cross-sectional profile), a shape having a substantially rectangular cross-sectional profile, a shape having a substantially square cross-sectional profile, an S-shape, and the like.

In some optional aspects, it is contemplated that the plurality of bores 64A, 64B can be asymmetrically distributed across the surface of the crown. For example, the plurality of bores plurality of bores 64A, 64B can be arranged at varying radial distances from the central axis, thereby promoting even cutting of the foundation and, accordingly, even wear across the face of the drill bit.

In one aspect, the crown 30 does not completely circumferentially enclose the interior space 110. In some exemplary aspects, the crown portions 34A, 34B do not comprise a waterway extending radially between the outer surface 40A, 40B of the first and second crown portions 34A, 34B and the interior space 110.

In another aspect, each of the first and second crown portions 34A, 34B can define a plurality of projections 66A, 66B extending outwardly from the cutting faces 60A, 60B relative to the longitudinal axis 12 of the drill bit 10. Optionally, the projections can be formed integrally with the crown portions 34A, 34B and can comprise the same material as the adjoining crown portions. Optionally, in exemplary aspects, the plurality of projections can comprise cutters or buttons as are known in the art. In these aspects, it is contemplated that the cutters or buttons can be secured to the crown portions 34A, 34B using conventional methods.

In exemplary aspects, the plurality of projections 66A, 66B can optionally be substantially equally distributed about the cutting faces 60A, 60B. Optionally, in some aspects, the plurality of projections 66A, 66B can be randomly spaced about each of the first and second crown portions 34A, 34B. In other aspects, the plurality of projections 66A, 66B can optionally be substantially uniformly spaced about the cutting faces 60A, 60B. In these aspects, it is contemplated that at least two concentric rows of projections can be provided, with the projections in each respective row being substantially uniformly spaced about the cutting faces 60A, 60B.

More generally, it is contemplated that the plurality of projections 66A, 66B can be provided in any selected configuration. It is further contemplated that the plurality of projections 66A, 66B can be distributed so as to optimize the wear characteristics of the drill bit 10 for a particular application.

It is contemplated that each projection of the plurality of projections 66A, 66B can be provided in a selected shape. In exemplary aspects, the plurality of projections 66A, 66B can have a substantially cylindrical shape (with substantially circular cross-sectional profile). However, it is contemplated that the plurality of projections 66A, 66B can have any shape, including, for example and without limitation, a substantially conical (tapered) shape (with a substantially circular cross-sectional profile), a shape having a substantially rectangular cross-sectional profile, a shape having a substantially square cross-sectional profile, an S-shape, and the like.

In a further aspect, the outer surfaces 40A, 40B of the crown portions 34A, 34B can define a plurality of channels 68A, 68B extending radially inwardly toward the longitudinal axis 12. In exemplary aspects, it is contemplated that the crown 30 can have an outer diameter that is greater than an outer diameter of the shank 20 such that the crown projects radially outwardly relative to the shank. Optionally, in these aspects, it is further contemplated that the plurality of channels 68A, 68B can expose and be in communication with a junction surface of the shank. It is further contemplated that the junction surface can optionally comprise at least one bore positioned in communication with at least one of the plurality of channels 68A, 68B of each of the first and second crown portions 34A, 34B. It is still further contemplated that the at least one bore of the junction surface of the shank 20 can be in communication with the interior space 110.

Optionally, in exemplary aspects, the plurality of channels 68A, 68B can be substantially equally circumferentially spaced about the outer surface 40A, 40B of the crown portions 34A, 34B. In one aspect, it is contemplated that the plurality of channels 68A, 68B can optionally be substantially equally sized.

Optionally, in some exemplary aspects, the plurality of channels 68A of the first crown portion 34A can comprise a first plurality of channels and a second plurality of channels, with each channel of the first plurality of channels having a first size and a second plurality of channels having a second size. In another aspect, the plurality of channels 68B of the second crown portion 34B can comprise a first plurality of channels and a second plurality of channels, with each channel of the first plurality of channels having the first size and a second plurality of channels having the second size. As used herein, the "size" of a channel 68A, 68B generally refers to the two-dimensional area of the channel, as measured within a plane that is substantially perpendicular to the longitudinal axis of the drill bit 10. In these aspects, it is contemplated that the second size can be larger than the first size. In additional exemplary aspects, at least one channel of the first plurality of channels of the first crown portion 34A can optionally be positioned circumferentially between sequential channels of the second plurality of channels of the first crown portion. In other exemplary aspects, at least one channel of the first plurality of channels of the second crown portion 34B can optionally be positioned circumferentially between sequential channels of the second plurality of channels of the second crown portion. In further exemplary aspects, each channel of the first plurality of channels of the first and second crown portions 34A, 34B can have a first radial length, and each channel of the second plurality of channels can have a second radial length. In these aspects, it is contemplated that the second radial length can optionally be greater than the first radial length.

In further optional aspects, it is contemplated that the plurality of channels 68A, 68B can further comprise a third plurality of channels, with each channel of the third plurality of channels having a third size that is different than the first and second sizes (of the first plurality of channels and the second plurality of channels). It is contemplated that the third size can be smaller than the first and second sizes. However, it is contemplated that, in exemplary aspects, the third size can also be larger than the first and second sizes. In additional exemplary aspects, it is contemplated that at least one channel of the third plurality of channels can optionally be positioned circumferentially between a respective channel of the first plurality of channels and a respective channel of the second plurality of channels. In further exemplary aspects, each channel of the third plurality of channels can have a third radial length. In these aspects, it is contemplated that the third radial length can optionally be less than the first and second radial lengths (of the first plurality of channels and the second plurality of channels). However, in other aspects, it is contemplated that the third radial length can optionally be greater than at least one of the first and second radial lengths.

More generally, it is contemplated that the plurality of channels 68A, 68B can comprise channels having any number of different sizes, such as, for example and without limitation, channels of at least four different sizes, channels of at least five different sizes, channels of at least six different sizes, channels of at least seven different sizes, and channels of at least eight different sizes. In exemplary aspects, it is contemplated that each channel of the plurality of channels 68A, 68B can have a size that differs from a size of at least one additional channel of the plurality of channels.

In additional aspects, each channel of the plurality of channels 68A of the first crown portion 34A can have a width. In a further aspect, each channel of the plurality of channels 68B of the second crown portion 34B can have a width. Optionally, in these aspects, it is contemplated that each channel of the plurality of channels 68A, 68B can have a variable width. For example, the width of each channel 68A of the first crown portion 34A can decrease from the outer surface 40A of the first crown portion moving radially inwardly toward the longitudinal axis 12. The width of each channel 68B of the second crown portion 34B can decrease from the outer surface 40B of the second crown portion moving radially inwardly toward the longitudinal axis 12. Thus, it is contemplated that each channel of the plurality of channels 68A, 68B can be inwardly tapered moving toward the longitudinal axis 12.

Optionally, it is contemplated that the radius of the shank 20 (corresponding to the radial distance between the (center) longitudinal axis 12 and an outer surface of the shank) can vary about the circumference of the shank. In exemplary aspects, it is contemplated that the outer surface of the shank 20 can be recessed a selected distance from the outer surfaces 40A, 40B of the crown portions 34A, 34B within each respective channel 68A, 68B. In these aspects, it is contemplated that the selected distance by which the outer surface of the shank 20 is recessed from the outer surfaces 40A, 40B of the crown portions 34A, 34B can vary from channel to channel. For example, it is contemplated that the selected distance by which the outer surface of the shank 20 is recessed from the outer surfaces 40A, 40B of the crown portions 34A, 34B can generally be greater for smaller channels than it is for larger channels. However, it is contemplated that any variation in the selected distance (and the radius of the shank 20) can be employed. Optionally, in exemplary aspects, the selected distance by which the outer surface of the shank 20 is recessed from the outer surfaces 40A, 40B of the crown portions can range from about 0.035 inches to about 1.5 inches (on each side).

Optionally, in further exemplary aspects, it is contemplated that an inner surface of the shank 20 can define at least one flute extending substantially parallel to the longitudinal axis 12 of the bit 10. In these aspects, each flute of the at least one flute can optionally correspond to a rounded groove extending radially from the inner surface of the shank 20 toward an outer surface of the shank. It is contemplated that the at least one flute can optionally be positioned in fluid communication with at least one of a bore 64A, 64B of the crown portions 34A, 34B and a bore of the shank 20.

In one aspect, and as further disclosed herein, the first and second crown portions 34A, 34B have a crown outer diameter and the shank has a shank outer diameter that is less than the outer diameter of the crown. Further, it is contemplated that the shank 20 can further define a tapered surface that extends distally from the shank outer diameter to the crown outer diameter. In various aspects, it is contemplated that the tapered surface can be angled with respect to the longitudinal axis 12 at an obtuse angle ranging from about 90.5° to about 150°, and preferably ranging from about 120° to about 140°.

In exemplary aspects, the crown 30 of the drill bit 10 disclosed herein can have a base surface 80 that is spaced from the cutting faces 60A, 60B of each of the crown portions 34A, 34B relative to the longitudinal axis 12 of the drill bit. As shown in FIGS. 1-14, the base surface 80 and the inner surfaces 42A, 42B of the first and second crown portions 34A, 34B can cooperate to define a slot 100.

Figure 22:
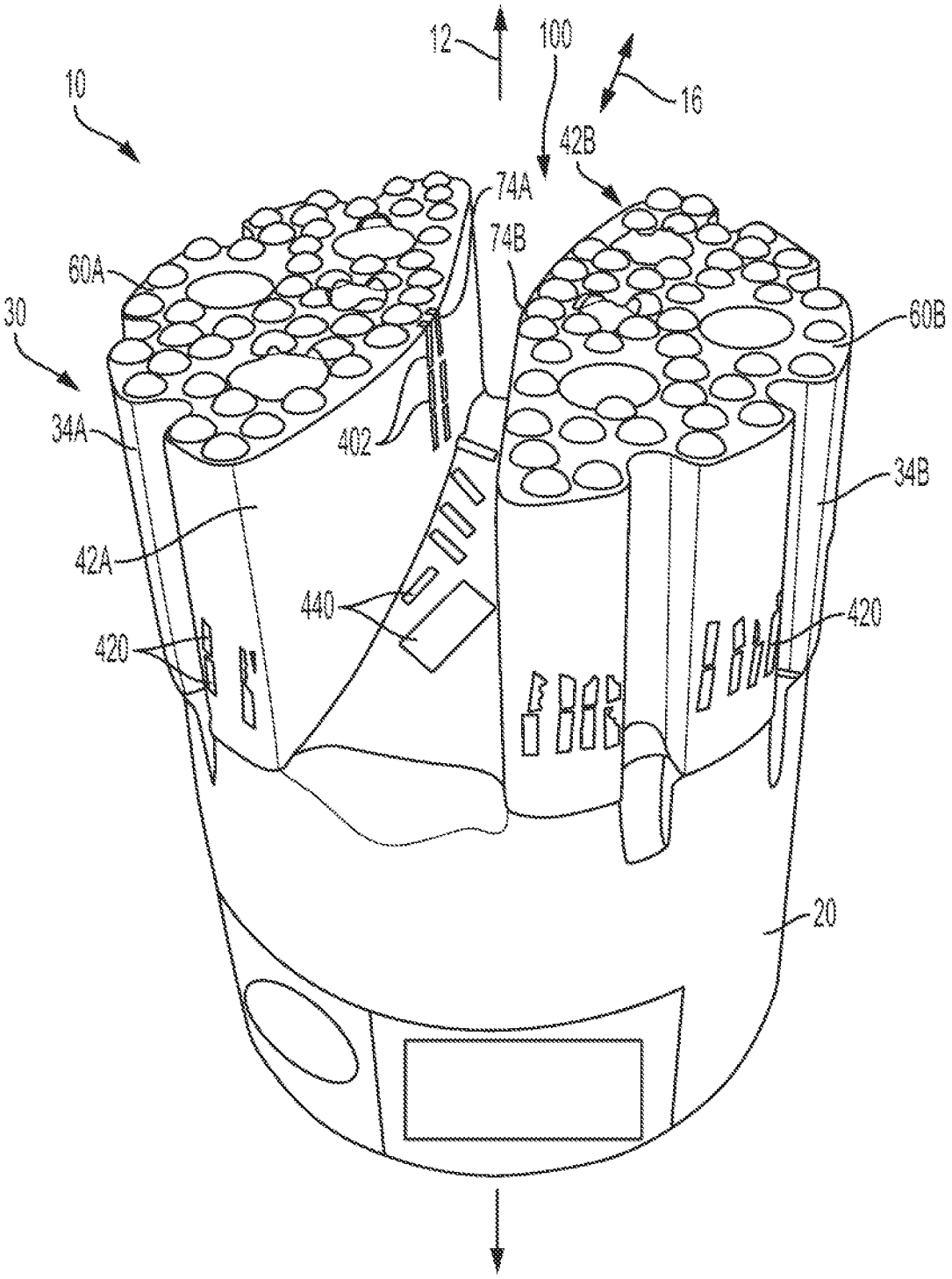
FIG. 22 is a perspective view of a drill bit having wear-resistant members that extend to a location proximate the cutting face.

In a further aspect, the slot 100 can extend longitudinally therein a portion of the cutting faces 60A, 60B and the circumferential outer surface 40A, 40B of the first and second crown portions 34A, 34B. It is contemplated that this slot can be configured to allow for the fracture and ejection of desired core samples. In an exemplary aspect, a conduit 120 can be defined in the drill bit 10 through the base surface 80 and positioned in communication with the interior space 110 and a portion of the slot 100. A source of pressurized drilling fluid can be positioned in communication with the conduit 120 such that a desired amount of drilling fluid can be delivered into the slot during a drilling operation. In further aspects, as shown in FIG. 22, it is contemplated that the conduit 120 can be omitted.

In a further aspect, the base surface 80 and the cutting face 60A of the first crown portion 34A can be spaced apart a first axial distance relative to the longitudinal axis 12. Optionally, in one exemplary aspect, the first axial distance can vary moving across the base surface 80 relative to the first transverse axis 14. In a further exemplary aspect, the first axial distance (between the base surface 80 and the cutting face 60A of the first crown portion 34A relative to the longitudinal axis 12) can vary moving across the base surface relative to the second transverse axis 16. In yet another exemplary aspect, the first axial distance (between the base surface 80 and the cutting face 60A of the first crown portion 34A relative to the longitudinal axis 12) can vary moving across the base surface relative to both the first transverse axis 14 and the second transverse axis 16. Optionally, in exemplary aspects, the first axial distance can range from about 0.25 inches to about 8 inches, and, more preferably, from about 0.25 inches to about 6 inches.

In optional contemplated aspects, at least a portion of the base surface 80 can be substantially planar and at least a portion of the base surface can be curved (either distally or proximally). In other contemplated aspects, the base surface 80 can have a compound curvature, with a first portion of the base surface having a first radius of curvature and at least a second portion of the base surface having a second radius of curvature different from the first radius of curvature.

In exemplary aspects, it is contemplated that the base surface 80 can further define an apex 84 that is spaced from the center 18 of the drill bit 10 relative to the longitudinal axis 12. Optionally, in these aspects, the apex 84 can be spaced from the center 18 of the drill bit 10 relative to the first transverse axis 14. Optionally, in another aspect, the apex 84 can be spaced from the center 18 of the drill bit 10 relative to the second transverse axis 16, which is perpendicular to the longitudinal axis 12 and the first transverse axis 14. In further aspects, the apex 84 can optionally be positioned proximate an inner surface 44A, 44B, 48A, 48B of one of the first and second crown portions 34A, 34B.

In an exemplary aspect, the base surface 80 can extend from a first base edge 86 to a second base edge 88 relative to the second transverse axis 16. In a further aspect, the first base edge 86 can extend between the first inner surfaces 44A, 44B of the first and second crown portions 34A, 34B and the second base edge 88 can extend from the second inner surfaces 48A, 48B of the first and second crown portions. Optionally, in an exemplary aspect, the first base edge 86 can be radially recessed from the outer surfaces 40A, 40B of the first and second crown portions 34A, 34B relative to the longitudinal axis 12 and the second base edge 88 can be radially recessed from the outer surfaces of the first and second crown portions relative to the longitudinal axis.

Figure 9:
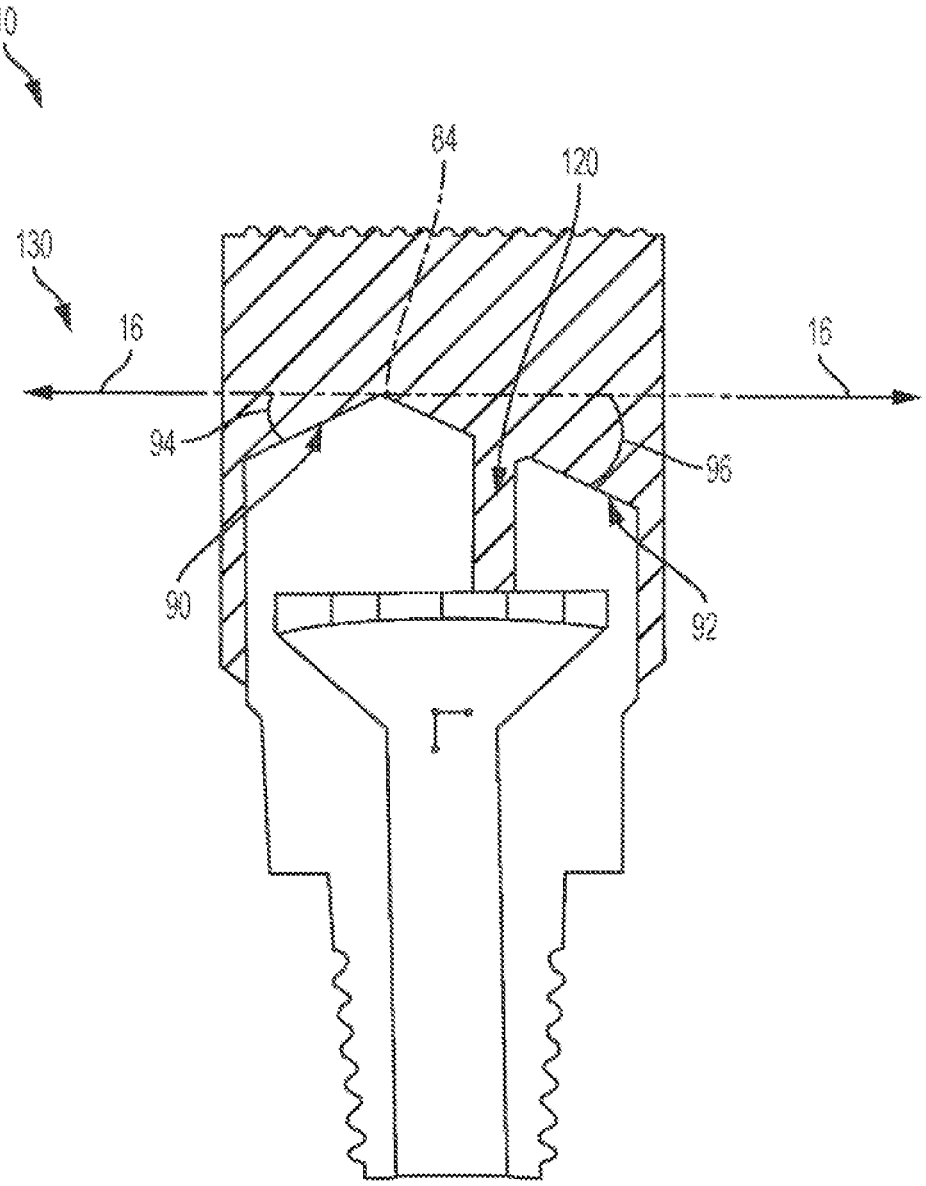
FIG. 9 depicts a cross-sectional view of the drill bit of FIG. 1, taken within plane 130.

As shown in FIG. 9, it is contemplated that within a plane 130 extending through the apex 84 and extending parallel to the longitudinal axis 12 and the second transverse axis 16 (perpendicular to the first transverse axis), the base surface 80 can define a first portion 90 extending between the first base edge 86 and the apex 84 and a second portion 92 extending between the second base edge 88 and the apex 84. In one exemplary aspect, and with reference to FIG. 7, the first portion 90 of the base surface 80 can be positioned at a first selected angle 94 relative to the second transverse axis 16. It is contemplated that the first selected angle 94 can range from about 0° to about 60°, and more preferably be about 30°. In still another exemplary aspect, the second portion 92 of the base surface 80 can be positioned at a second selected angle 96 relative to the second transverse axis 16. It is contemplated that the second selected angle 96 can range from about 0° to about 75°, and more preferably be about 45°. Optionally, in exemplary aspects, it is contemplated that the sum of the first and second selected angles 94, 96 can be about 90°.

Figure 10:
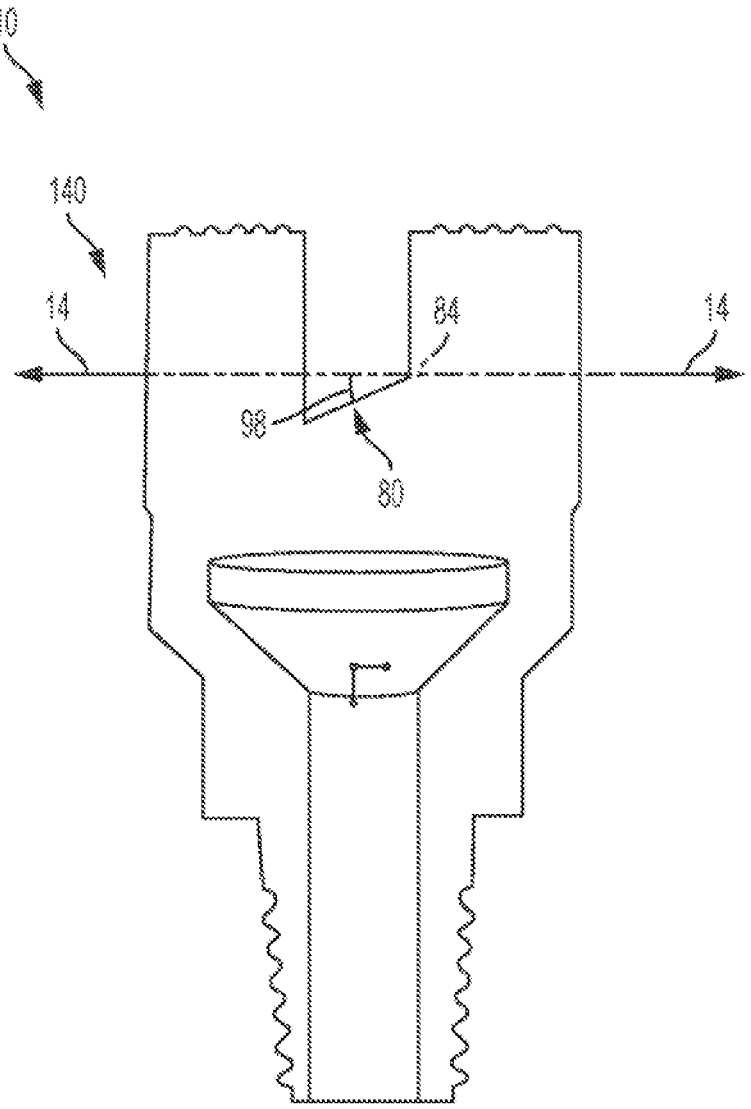
FIG. 10 depicts a cross-sectional view of the drill bit of FIG. 1, taken within plane 140.
Figure 11:
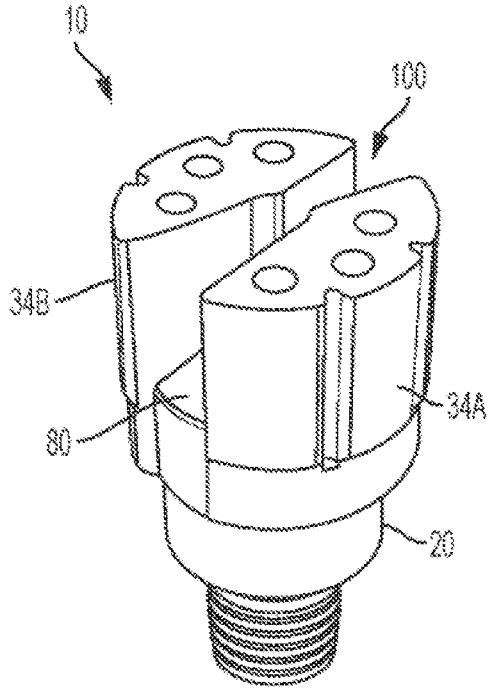
FIG. 11 is a top perspective view of another exemplary drill bit having two crown portions as disclosed herein.
Figure 12:
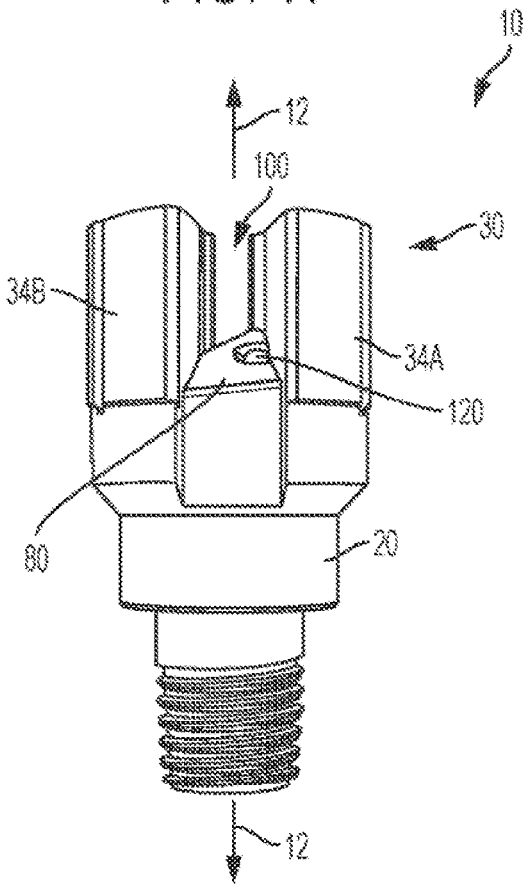
FIG. 12 is a right side view of the drill bit of FIG. 11.
Figure 13:
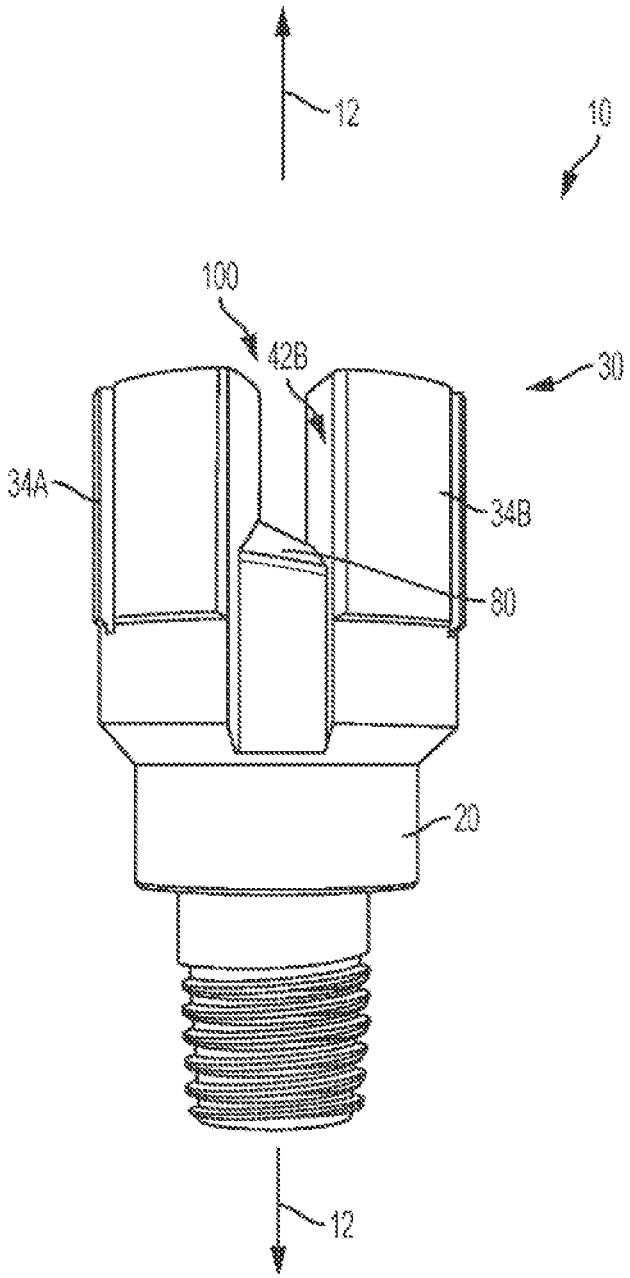
FIG. 13 is a left side view of the drill bit of FIG. 11.

As shown in FIG. 10, it is contemplated that within a plane 140 extending through the apex 84 and extending parallel to the longitudinal axis 12 and the first transverse axis 14 (perpendicular to the second transverse axis 16), the base surface 80 can be positioned at a selected angle 98 relative to the first transverse axis 14. It is contemplated that the selected angle 98 can range from about 0° to about 30°, extending away from the apex 84 at either a decline or an incline. It is further contemplated that the selected angle 98 is more preferably about 15°.

In exemplary aspects, it is contemplated that, from the apex 84, the base surface 80 can be tapered or generally tapered toward the first and second base edges 86, 88. In these aspects, within a first reference plane (not shown) that is parallel to the longitudinal axis 12 and that passes through the apex 84 and a reference point on the first base edge 86, the base surface 80 can be positioned at a taper angle relative to the second transverse axis 16. It is contemplated that the taper angle defined by the base surface 80 can increase as the reference point on the first base edge 86 approaches the first inner surface 44A of the first crown portion 34A (and moves away from the first inner surface 44B of the second crown portion 34B). In further aspects, within a second reference plane (not shown) that is parallel to the longitudinal axis 12 and that passes through the apex 84 and a reference point on the second base edge 88, the base surface 80 can be positioned at a taper angle relative to the second transverse axis 16. It is contemplated that the taper angle defined by the base surface 80 can increase as the reference point on the second base edge 88 approaches the second inner surface 48B of the second crown portion 34B (and moves away from the second inner surface 48A of the first crown portion 34A). Optionally, in exemplary aspects, the taper angle can range from about 0 degrees to about 45 degrees relative to the second transverse axis 16. Drill Bits Having Three Crown Portions Optionally, in exemplary aspects, and with reference to FIGS. 15-19, a drill bit 200 comprising three crown portions can be provided. In these aspects, the three crown portions comprise first, second, and third crown portions 234A, 234B, 234C that are substantially equally spaced about the operative circumference 232 of the crown 230. Inner surfaces of the crown portions 234A, 234B, 234C can cooperate with a base surface 280 to define a slot 300 as further disclosed herein. Generally, it is contemplated that the base surface 280 and the slot 300 of the drill bit 200 can have corresponding characteristics to the base surface 80 and slot 100 of drill bit 10. It is further contemplated that the features of each crown portion can correspond to the previously described features of the crown portions of drill bit 10.

In exemplary aspects, as further disclosed herein with respect to drill bit 10, the drill bit 200 can further comprise a conduit 320 defined through the base surface 280 and positioned in communication with the interior space (not shown) and with a portion of the slot 300. In these aspects, the drill bit 200 can optionally comprise a source of pressurized drilling fluid in fluid communication with the conduit 320 such that a desired amount of drilling fluid can be delivered into the slot 300 during a drilling operation.

In another optional aspect, the drill bit 200 can further comprise a plurality of bores 364A, 364B, 364C defined within each of the crown portions 234A, 234B, 234C, with each bore extending from a cutting face 360A, 360B, 360C of each of the crown portions to the interior space. It is contemplated that the bores 364A, 364B, 364C defined within each of the crown portions 234A, 234B, 234C can have corresponding features to the bores disclosed herein with respect to bit 10.

In another optional aspect, the drill bit 200 can further comprise a plurality of projections (not shown) defined within each of the crown portions 234A, 234B, 234C that extend outwardly from the cutting face 360A, 360B, 360C of each of the crown portions relative to the longitudinal axis 202 of the drill bit 200. It is contemplated that the projections defined within each of the crown portions 234A, 234B, 234C can have corresponding features to the projections disclosed herein with respect to bit 10.

Optionally, in a further aspect, each of the crown portions 234A, 234B, 234C does not comprise a waterway extending radially between the outer surfaces 240A, 240B, 240C of the crown portions and the interior space.

Optionally, in an additional aspect, the outer surfaces 240A, 240B, 240C of the crown portions respectively define a plurality of channels 268A, 268B, 268C extending radially inwardly toward the longitudinal axis 202. It is contemplated that the channels 268A, 268B, 268C defined within each of the crown portions 234A, 234B, 234C can have corresponding features to the channels disclosed herein with respect to bit 10.

Optionally, in other exemplary aspects, the at least one inner surface of each of the crown portions 234A, 234B, 234C comprises a plurality of inner surfaces.

Figure 19:
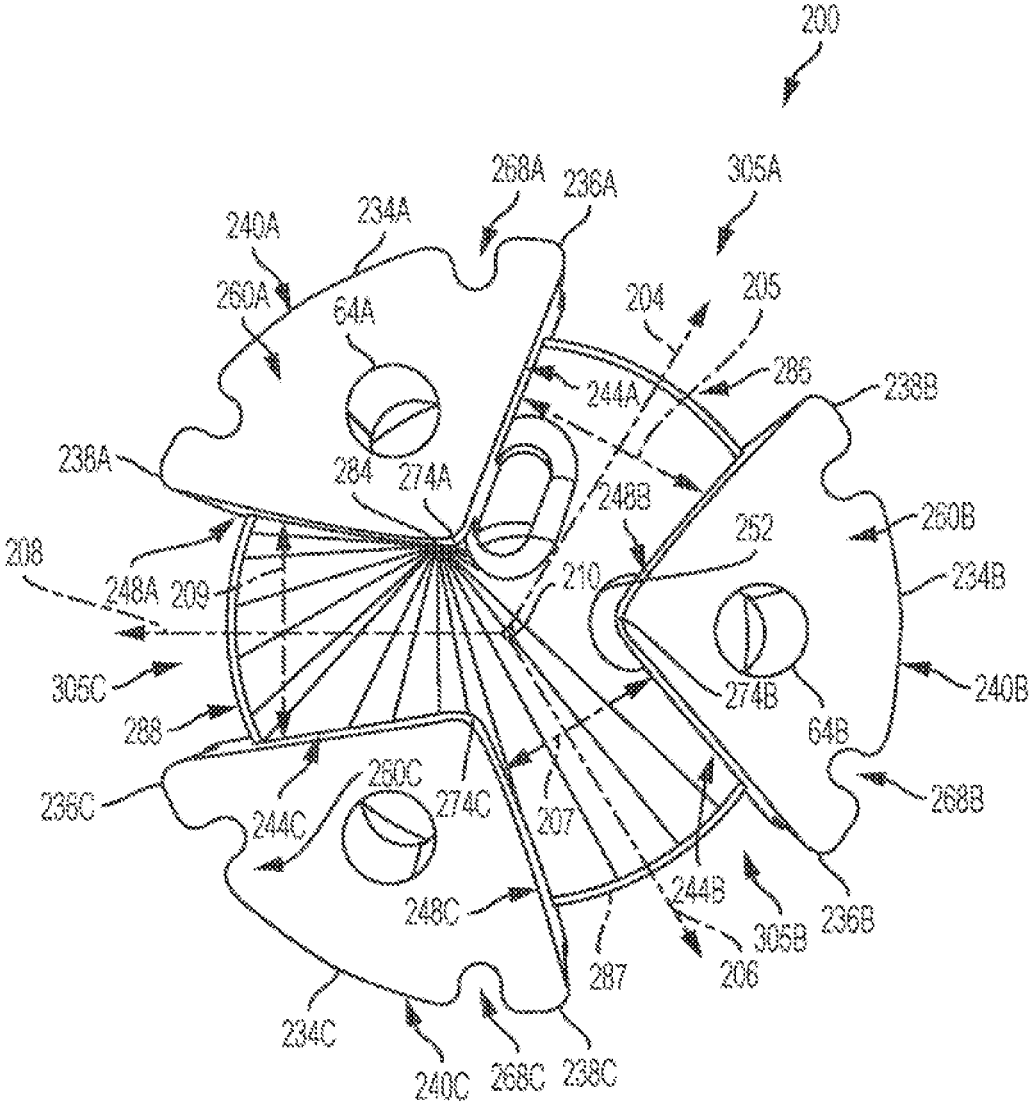
FIG. 19 is a top view of the drill bit of FIG. 15.

In one exemplary aspect, the at least one inner surface of each of the crown portions 234A, 234B, 234C comprises a first inner surface 244A, 244B, 244C, a second inner surface 248A, 248B, 248C, and a longitudinal medial edge 274A, 274B, 274C. In this aspect, the first inner surface 244A, 244B, 244C can extend from the first longitudinal edge 236A, 236B, 236C of the crown portion 234A, 234B, 234C to the longitudinal medial edge 274A, 274B, 274C, and the second inner surface 248A, 248B, 248C can extend from the second edge 238A, 238B, 238C of the crown portion to the longitudinal medial edge. In exemplary aspects, and as shown in FIG. 19, the first inner surface 244A, 244B, 244C and the second inner surface 248A, 248B, 248C of each of the crown portions 234A, 234B, 234C can be angularly oriented relative to each other at a desired angle 252. In these aspects, it is contemplated that the desired angle 252 can range from about 10 degrees to about 345 degrees and, more preferably, from about 200 degrees to about 345 degrees.

In a further aspect, the cutting faces 260A, 260B, 260C of the crown portions 234A, 234B, 234C can have respective heights relative to the longitudinal axis 202 of the drill bit. Optionally, the heights of the cutting faces 260A, 260B, 260C of the crown portions 234A, 234B, 234C can be substantially equal. However, in some optional aspects, the height of at least one cutting face 260A, 260B, 260C of the crown portions can be different than the height of at least one other cutting face of the crown portions.

Figure 18:
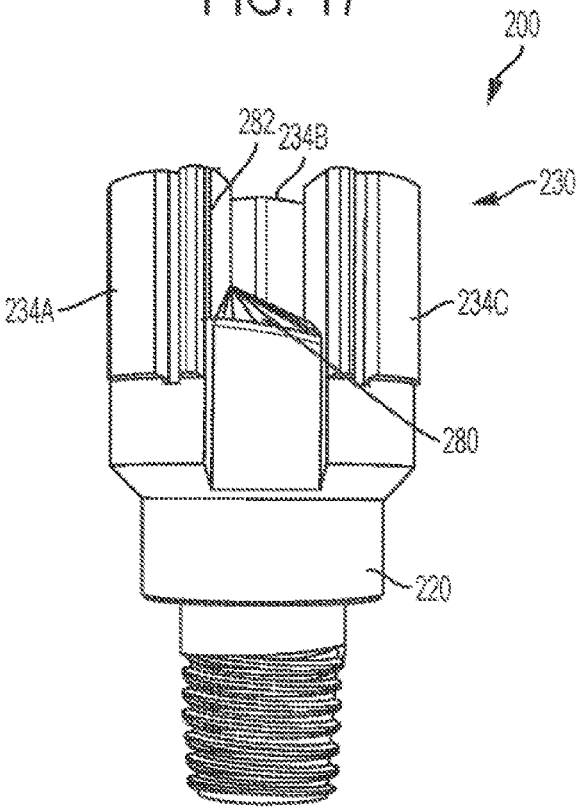
FIG. 18 is a third side view of the drill bit of FIG. 15, showing a third slot portion defined by the first and third crown portions of the bit.

In one exemplary aspect, and with reference to FIGS. 18-19, the base surface 280 and at least one cutting face (i.e., all the cutting faces 260A, 260B, 260C when the height of the cutting faces is equal, or any one of the cutting faces when the cutting faces have different heights) of the crown portions 234A, 234B, 234C are spaced apart by a first axial distance 282 relative to the longitudinal axis 202. In this aspect, it is contemplated that the first axial distance 282 can vary moving across the base surface 280 relative to a first transverse axis 204 that is perpendicular to the longitudinal axis 202 of the drill bit 200 and that substantially bisects a first slot portion 305A defined between the first and second crown portions 234A, 234B. Optionally, in this aspect, it is further contemplated that the first axial distance 282 can vary moving across the base surface 280 relative to a first opposing axis 205 that is perpendicular to and co-planar with the first transverse axis 204. Optionally, in exemplary aspects, the first axial distance can range from about 0.25 inches to about 8 inches, and, more preferably, from about 0.25 inches to about 6 inches.

In a further aspect, it is contemplated that the first axial distance 282 can vary moving across the base surface 280 relative to a second transverse axis 206 that is perpendicular to the longitudinal axis 202 and that substantially bisects a second slot portion 305B defined between the second and third crown portions 234B, 234C. Optionally, in this aspect, it is further contemplated that the first axial distance 282 can vary moving across the base surface 280 relative to a second opposing axis 207 that is perpendicular to and co-planar with the second transverse axis 206.

In still another aspect, it is contemplated that the first axial distance 282 can vary moving across the base surface 280 relative to a third transverse axis 208 that is perpendicular to the longitudinal axis 202 and that substantially bisects a third slot portion 305C defined between the first and third crown portions 234A, 234C. Optionally, in this aspect, it is further contemplated that the first axial distance 282 can vary moving across the base surface 280 relative to a third opposing axis 209 that is perpendicular to and co-planar with the third transverse axis 208.

Optionally, in exemplary aspects, the first axial distance 282 can vary moving across the base surface 280 relative to the first transverse axis 204 and the second transverse axis 206. Optionally, in further exemplary aspects, the first axial distance 282 can vary moving across the base surface 280 relative to the second transverse axis 206 and the third transverse axis 208. In further optional aspects, the first axial distance 282 can vary moving across the base surface 280 relative to the first transverse axis 204 and the third transverse axis 208.

In one exemplary aspect, the base surface 280 of the drill bit 200 can have a compound curvature, with a first portion of the base surface having a first radius of curvature and at least a second portion of the base surface having a second radius of curvature different from the first radius of curvature. In a further aspect, the base surface 280 can have an apex 284 that is spaced from the center 210 of the drill bit relative to the longitudinal axis 202.

In another exemplary aspect, the apex 284 can be spaced from the center 210 of the drill bit relative to a transverse axis 204, 206, or 208 that is perpendicular to the longitudinal axis 202. In this aspect, it is contemplated that the transverse axis 204, 206, or 208 can substantially bisect a slot portion 305A, 305B, or 305C defined between a pair of consecutive crown portions as further disclosed herein. In a further exemplary aspect, the apex 284 can be positioned proximate the at least one inner surface of a crown portion of the pair of crown portions that defines the slot portion that is substantially bisected by the transverse axis.

In an additional aspect, the base surface 280 can extend radially inwardly from first, second, and third base edges 286, 287, 288 toward the center 210 of the drill bit 200. In this aspect, the first base edge 286 can extend between the at least one inner surface of the first crown portion 234A and the at least one inner surface of the second crown portion 234B, the second base edge 287 can extend between the at least one inner surface of the second crown portion 234B and the at least one inner surface of the third crown portion 234C, and the third base edge 288 can extend between the at least one inner surface of the third crown portion 234C and the at least one inner surface of the first crown portion 234A. Optionally, in this aspect, the first base edge 286 can be radially recessed from the outer surfaces 240A, 240B of the first and second crown portions 234A, 234B relative to the longitudinal axis 202, the second base edge 287 can be radially recessed from the outer surfaces 240B, 240C of the second and third crown portions 234B, 234C relative to the longitudinal axis 202, and the third base edge 288 can be radially recessed from the outer surfaces 240A, 240C of the first and third crown portions 234A, 234C relative to the longitudinal axis 202.

As one will appreciate, and with reference to FIG. 19, during normal rotation of the drill bit 200, the second inner surfaces 248A, 248B, 248C of the crown portions 234A, 234B, 234C can serve as the leading edges of the drill bit, with the first inner surface 244A, 244B, 244C of the crown portion serving as the trailing edges of the drill bit. However, it is contemplated that the direction of rotation of the drill bit can be reversed, such that the first inner surfaces 244A, 244B, 244C of the crown portions 234A, 234B, 234C serve as the leading edges of the drill bit, with the second inner surfaces 248A, 248B, 248C of the crown portions serving as the trailing edges of the drill bit.

Other Drill Bit Features

In an exemplary aspect, it is contemplated that a distal end of the conduit 120, 320 can be formed in at least a portion of the base surface 80, 280 of the slot 100, 300. Further, it is contemplated that the distal end of the conduit 120, 320 can be formed in a portion of the at least one inner surface of the crown portions. In another exemplary embodiment, the distal end of the conduit 120, 320 can be positioned such that a portion of the conduit is positioned at a juncture of a portion of the base surface and a portion of the at least one inner surface.

In exemplary aspects, when the drill bit 10, 200 comprises both the slot 100, 300 and a plurality of bores, it is contemplated that the slot can allow core to substantially freely flow from the cutting faces to the outer diameter of the crown 30, 230. It is further contemplated that the non-uniform crown can create an off-balance motion, thereby permitting easier breaking of the core.

In exemplary aspects, the drill bit 10, 200 disclosed herein can be a diamond-impregnated bit, with the diamonds (natural, synthetic, or combinations thereof) impregnated within a matrix. In these aspects, it is contemplated that drill bit 10, 200 can comprise a plurality of selected materials, with each material being provided as a selected weight percentage of the drill bit. In operation, and in contrast to surface-set bits having fixed cutting elements, it is contemplated that the matrix of the diamond-impregnated bit can be configured to wear in a manner that continually exposes diamond particles or pieces throughout at least a portion of the crown of the bit, thereby retaining cutting effectiveness throughout the life of the bit. It is contemplated that drill bit 10, 200 can comprise carbon (not including diamond) in any desired amount, such as, for example and without limitation, an amount ranging from about 0.00% to about 7.00% by weight of the drill bit. In exemplary aspects, the carbon of the drill bit 10 can be provided as at least one of carbon powder and carbon fibers. It is further contemplated that the drill bit 10, 200 can comprise chromium in any desired amount, such as, for example and without limitation, an amount ranging from about 0.00% to about 1.00% by weight of the drill bit. It is further contemplated that the drill bit 10 can comprise cobalt in any desired amount, such as, for example and without limitation, an amount ranging from about 0.00% to about 1.00% by weight of the drill bit. Optionally, it is further contemplated that the drill bit 10, 200 can comprise copper in any desired amount, such as, for example and without limitation, an amount ranging from about 0.00% to about 30.00% by weight of the drill bit. It is further contemplated that the drill bit 10, 200 can comprise iron in any desired amount, such as, for example and without limitation, an amount ranging from about 50.00% to about 90.00% by weight of the drill bit. It is further contemplated that the drill bit 10, 200 can comprise manganese in any desired amount, such as, for example and without limitation, an amount ranging from about 0.00% to about 8.00% by weight of the drill bit. It is further contemplated that the drill bit 10, 200 can comprise molybdenum in any desired amount, such as, for example and without limitation, an amount ranging from about 0.00% to about 0.20% by weight of the drill bit. It is further contemplated that the drill bit 10, 200 can comprise nickel in any desired amount, such as, for example and without limitation, an amount ranging from about 0.00% to about 6.00% by weight of the drill bit. It is further contemplated that the drill bit 10, 200 can comprise silicon in any desired amount, such as, for example and without limitation, an amount ranging from about 0.00% to about 0.50% by weight of the drill bit. It is further contemplated that the drill bit 10, 200 can comprise silicon carbide in any desired amount, such as, for example and without limitation, an amount ranging from about 0.00% to about 2.00% by weight of the drill bit. It is further contemplated that the drill bit 10, 200 can comprise silver in any desired amount, such as, for example and without limitation, an amount ranging from about 0.00% to about 12.00% by weight of the drill bit. It is further contemplated that the drill bit 10, 200 can comprise tin in any desired amount, such as, for example and without limitation, an amount ranging from about 0.00% to about 6.00% by weight of the drill bit. It is further contemplated that the drill bit 10, 200 can comprise tungsten in any desired amount, such as, for example and without limitation, an amount ranging from about 0.00% to about 41.00% by weight of the drill bit. It is further contemplated that the drill bit 10, 200 can comprise tungsten carbide in any desired amount, such as, for example and without limitation, an amount ranging from about 0.00% to about 35.00% by weight of the drill bit. It is further contemplated that the drill bit 10, 200 can comprise zinc in any desired amount, such as, for example and without limitation, an amount ranging from about 0.00% to about 24.00% by weight of the drill bit. It is further contemplated that the matrix of the drill bits disclosed herein can be configured to form supporting structures behind the diamonds within the drill bits, thereby preventing the polishing of the impregnated diamonds during operation. In some optional aspects, it is contemplated that the drill bits 10, 200 as disclosed herein can be formed in accordance with the manufacturing technique described in U.S. Pat. No. 10,702,975, granted Jul. 7, 2020, the entirety of which is hereby incorporated by reference herein.

In exemplary aspects, the drill bit 10, 200 disclosed herein can further optionally comprise a plurality of wear-resistant members that are embedded therein portions of at least one of the base surface 80, 280 and/or the at least one inner surface of the crown portions of the drill bit. It is contemplated, optionally and without limitation, that the plurality of wear-resistant members can be embedded therein portions of the base surface 80, 280 adjacent to the at least one inner surface that serves as the impact wall (e.g., the trailing wall) as a result of the rotation of the drill bit in use. In this aspect, it is contemplated that the plurality of wear-resistant members can be embedded in an area of the base surface 80, 280 proximate to the juncture of the base surface and the respective inner surfaces. In a further aspect, the plurality of wear-resistant members in the base surface can be positioned in a desired, predetermined array. In one example, the array of the plurality of wear-resistant members can comprise a series of rows of wear-resistant members. In this aspect, it is contemplated that each row can comprise a plurality of the wear-resistant members positioned substantially along a common axis. Optionally, the common axis can be substantially parallel to the adjacent at least one inner surface. Thus, it is contemplated that the array of the plurality of wear-resistant members can comprise a series of rows of wear-resistant members in which each of the rows are substantially parallel to each other and to the adjacent at least one inner surface.

In a further aspect, optionally and without limitation, the plurality of wear-resistant members can be embedded therein portions of the inner surface that serves as the impact wall (e.g., the trailing wall) as a result of the rotation of the drill bit in use. In this aspect, it is contemplated that the plurality of wear-resistant members can be embedded in an area of the at least one inner surface proximate to the juncture of the base surface 80, 280 and the at least one inner surface. In a further aspect, the plurality of wear-resistant members in the base surface 80, 280 can be positioned in a desired, predetermined array. In one example, the array of the plurality of wear-resistant members can comprise a series of rows of wear-resistant members. In this aspect, it is contemplated that each row can comprise a plurality of the wear-resistant members positioned substantially along a common axis. Optionally, the common axis can be substantially parallel to the adjacent base surface. Thus, it is contemplated that the array of the plurality of wear-resistant members can comprise a series of rows of wear-resistant members in which each of the rows are substantially parallel to each other and to the adjacent base surface 80, 280. In a further aspect, the array of the plurality of wear-resistant members positioned on the at least one inner surface can be spaced away from the cutting faces of the drill bit 10, 200 at a desired distance.

In another aspect, at least a portion of the plurality of wear resistant members (wear resistant members 440) can extend proudly from the respective base surface 80, 200 and/or at least one inner surface in which it is embedded. In some optional aspects, the respective base surface 80, 200 can be curved while the wear resistant members 440 are flat, thereby resulting in at least portions of the wear resistant members 440 protruding from the base surface. In one aspect, it is further contemplated that the array can comprise additional rows of wear resistant members that are encapsulated within the drill bit 10, 200 in an underlying relationship with the exposed rows of the wear-resistant members that are positioned in one of the base surface 80, 280 and/or the at least one inner surface of the drill bit 10, 200. In this fashion, the additional wear-resistant members can be exposed upon the normal wear of the drill bit 10, 200 during operation.

In some optional aspects, it is contemplated that the base surface can have a diamond powder deposited (e.g., sprinkled) thereon. The diamond powder can optionally be deposited after the wear resistant members 440 have been positioned. For example, the wear-resistant members can be positioned in a mold, and the diamond powder can then be deposited in the mold. Thereafter, the material that forms the bulk of the drill bit 10, 200 can fill the mold. The diamond powder can serve to inhibit wear of the surface(s) on which the diamond powder is deposited.

In further aspects, at least a portion of the plurality of wear-resistant members can comprise a plurality of gauge surface wear-resistant members 420 that are disposed within and define at least a portion of outer surfaces 40A, 40B of the crown portions, thereby defining at least a portion of the gauge surface of the crown. The plurality of gauge surface wear-resistant members 420 can be arranged in rows (e.g., two or three rows) that are spaced along the longitudinal axis 12 of the bit. The plurality of gauge surface wear-resistant members 420 can further be arranged in columns that are spaced circumferentially around the bit. It is contemplated that the gauge surface wear-resistant members 420 can be difficult to machine. Accordingly, the plurality of gauge surface wear-resistant members 420 can be spaced from the cutting faces 60A, 60B of each bit by a select distance (e.g., at least one inch, or at least half of the longitudinal length of the crown portions). Optionally, the select distance can be a function of the crown height. For example, the gauge surface wear-resistant members 420 can comprise one or more rows that begin at the base (proximal portion) of the crown portions, and the remaining length of the crown portions beyond the one or more rows of gauges surface wear-resistant members 420 can determine the select distance.

In one aspect, at least one (optionally, each) wear-resistant member can be an elongated member, for example and without limitation, an elongate member can have a rectangular or generally rectangular shape having a longitudinal axis. It is contemplated that the elongate members can be positioned such that the longitudinal axis of each elongate member is parallel or substantially parallel to the adjacent base surface and/or at least one inner surface. Without limitation, it is contemplated that each wear-resistant member can comprise at least one of Tungsten Carbide, TSD (thermally stable diamond), PDC (polycrystalline diamond compact), CBN (cubic boron nitride), single crystal Aluminum Oxide, Silicon Carbide, wear resistant ceramic materials, synthetic diamond materials, natural diamond, and polycrystalline diamond materials.

Wear-Resistant Members for Reinforcing the Face of the Drill Bit

Figure 21:
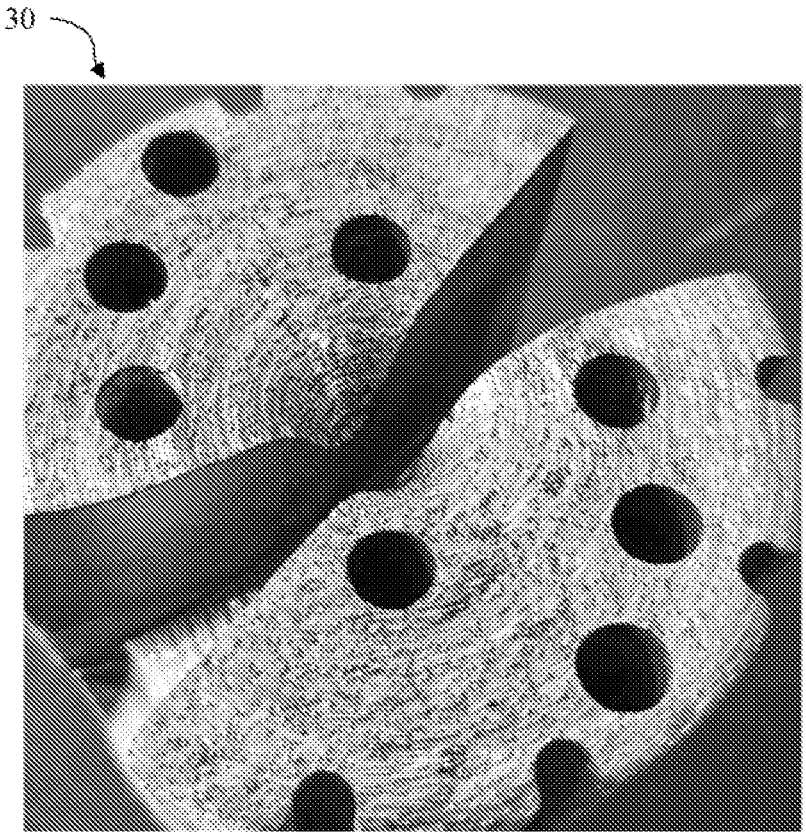
(Related Art) FIG. 21
FIG. 21 is a perspective view of a drill bit showing a wear pattern for a bit lacking cutting face reinforcement.

As shown in FIG. 21, and as further stated herein, it is contemplated that portions of the drill bit face that are closer to the longitudinal (central) axis of the drill bit have a lower linear (surface) velocity tangential to the rotational movement of the drill bit than portions of the drill bit face that are farther from the longitudinal axis of the drill bit. Because of the relatively slow linear (surface) velocity, the portions of the drill bit proximate (radially proximate) to the longitudinal axis are subject to more rapid wear than the portions of the drill bit (radially) spaced relatively farther from the longitudinal axis. That is, the drill bit can wear more quickly toward the center of the bit.

Figure 23:
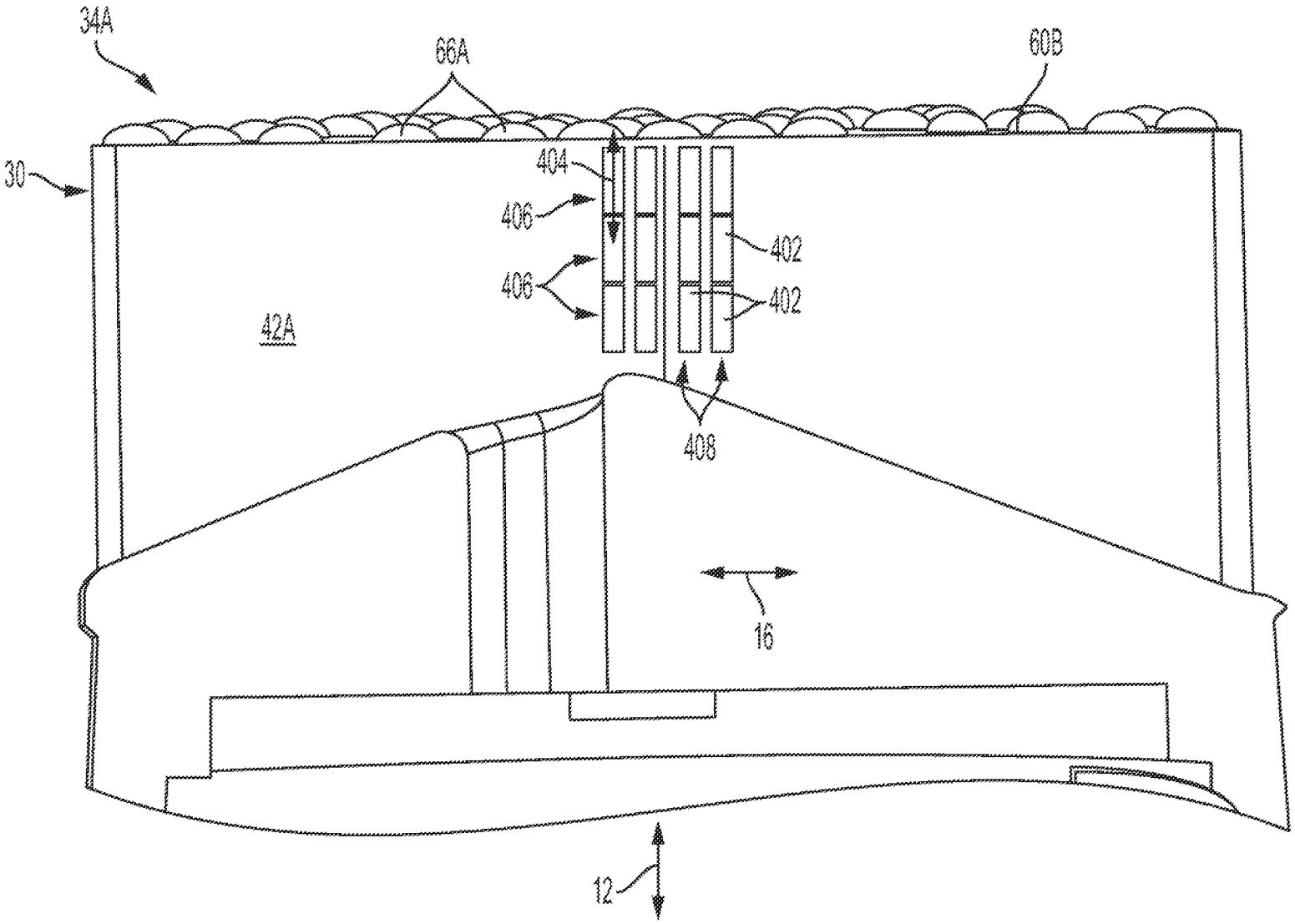
FIG. 23 is a cross sectional view of a distal portion of the drill bit of FIG. 22.
Figure 24:
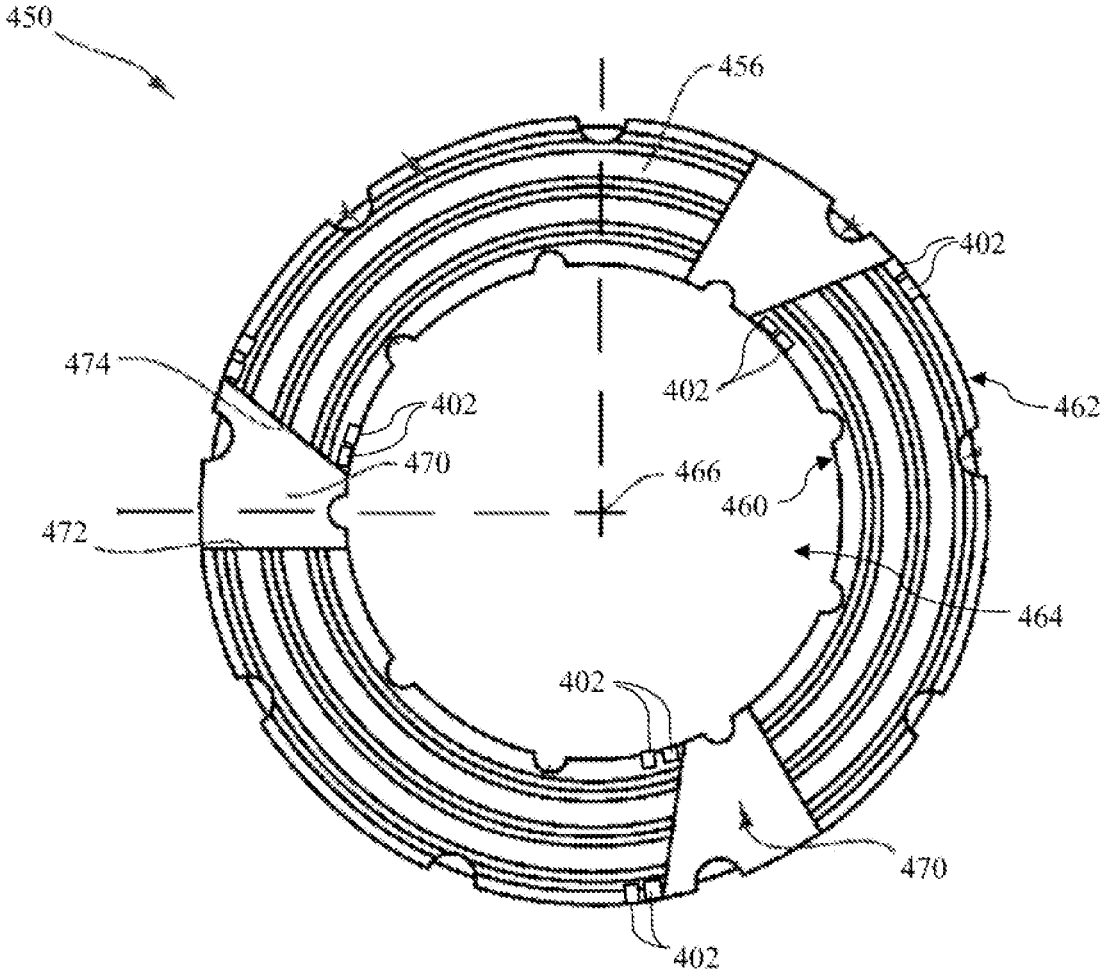
FIG. 24 is a distal end view of a drill bit in accordance with embodiments herein having wear resistant members.
Figure 25:
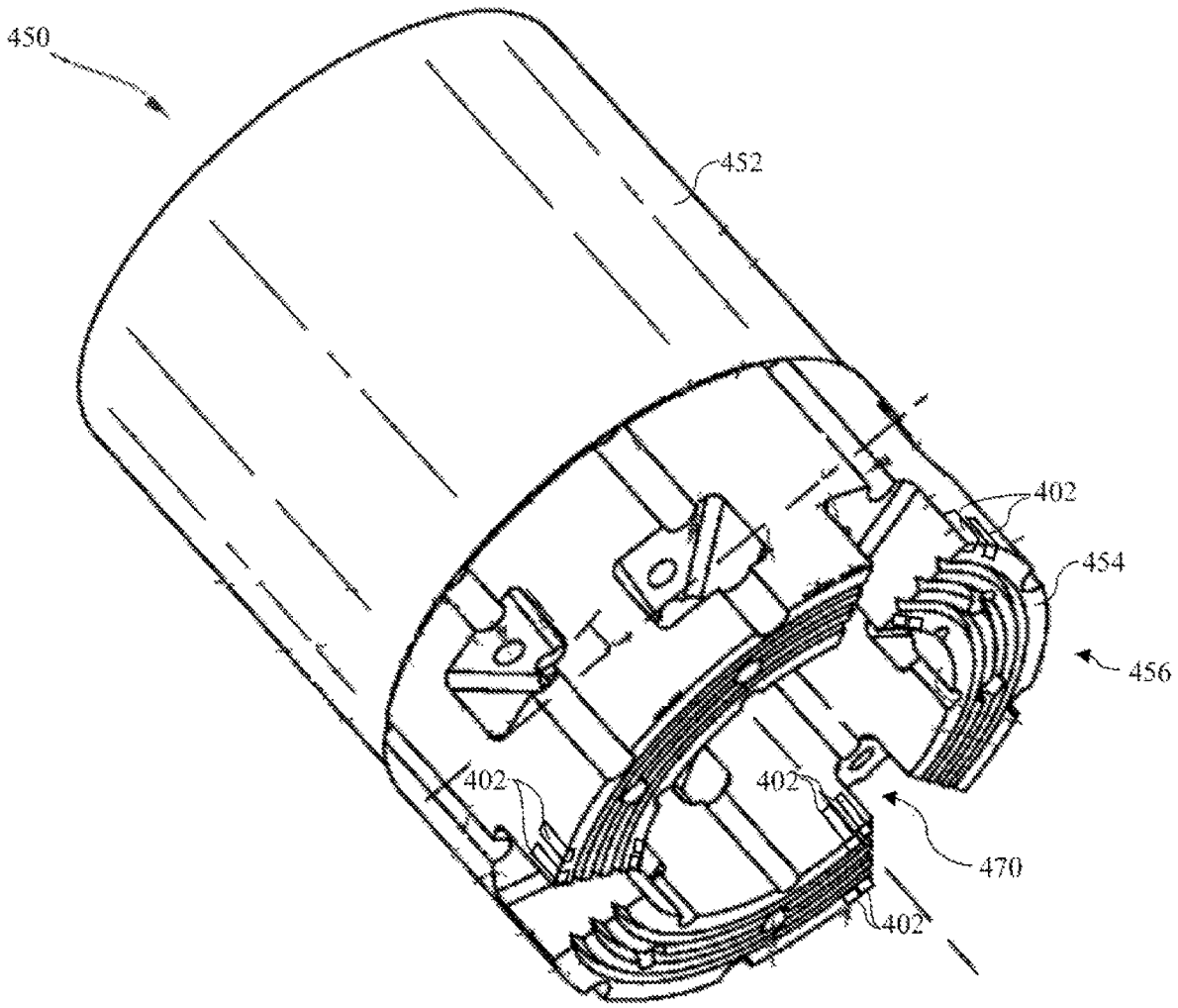
FIG. 25 is a perspective view of the drill bit of FIG. 24.

Accordingly, in further aspects, and with reference to FIGS. 22 and 23, a plurality of wear-resistant members 402 can be embedded in the crown of the drill bit 10. At least one of the wear-resistant members 402 can have a distal-most portion or surface that extends to within 0.1 inches of the cutting face 60A,60B of each crown portion 34A,34B of the drill bit 10 (measured along longitudinal axis 12). In various aspects, a plurality of wear-resistant members 402 can extend to within 0.25 inches, within 0.2 inches, within 0.15 inches, within 0.1 inches, or within 0.05 inches of the cutting face 60A,60B of each crown portion 34A,34B of the drill bit 10 (measured along longitudinal axis 12). In various aspects, the distal-most portion or surface of at least one of the wear resistant members 402 can extend to the cutting face of each crown portion of the drill bit. Optionally, in these aspects, it is contemplated that the at least one wear resistant member 402 can define a portion of the cutting face. In still further aspects, the distal-most portion or surface of at least one wear resistant member 402 can extend distally beyond (e.g., project distally from) the cutting face.

To avoid the detrimental effects that wear-resistant members have on cutting efficiency, optionally, the wear resistant member(s) 402 that extend to within a specified distance of the cutting face 60A,60B (e.g., within 0.1 inches of the cutting face) of each crown portion 34A,34B can be entirely within a select radius of the longitudinal axis 12 of the drill bit 10 so that none of the wear resistant member(s) 402 that extend to within the specified distance (e.g., 0.1 inches) of the cutting face 60A,60B is outside said select radius. The select radius can be, for example, 1 inch, ¾ inch, ½ inch, at least a ½ inch, 3/16 inch, ¼ inch, at least ¼ inch, or less than ¼ inch. More broadly, it is contemplated that at least one (optionally, each) of the wear resistant member(s) 402 that extend to within the specified distance (e.g., 0.1 inches) of the cutting face 60A,60B can be at least partially (optionally, entirely) within the select radius of the longitudinal axis 12 of the drill bit 10.

Optionally, the wear-resistant members 402 can have respective longitudinal axes 404. In various aspects, the longitudinal axes 404 can be generally parallel to the longitudinal axis 12 of the drill bit (e.g., within +/−10 degrees, within +/−5 degrees, or within +/−1 degree) or parallel to the longitudinal axis 12.

In some optional aspects, the wear-resistant members 402 can comprise thermally stable diamond (TSD) pins. In further aspects, the wear-resistant members 402 can comprise other materials, such as, for example, tungsten carbide. The wear-resistant members 402 (e.g., TSD pins) can optionally have dimensions of 1.5 mm×1.5 mm×5 mm, although other dimensions are contemplated.

The wear-resistant members 402 can at least partially define the inner surfaces 42A,42B of the crown portions 34A,34B, thereby defining at least a portion of the slot 100. It is contemplated that the wear-resistant members described herein can be positioned in the mold in which the bit is formed (e.g., glued to surfaces of the mold), and thereafter, a matrix powder can fill the mold around the wear-resistant members 402. Optionally, additional wear-resistant members can be inserted within the matrix powder.

In various aspects, the wear-resistant members 402 can be arranged in a pattern. For example, the wear-resistant members 402 can be arranged in a plurality of rows 406 (e.g., three rows) that are spaced along the longitudinal axis 12. In further aspects, the wear-resistant members 402 can be arranged in columns. For example, a plurality of columns 408 can be spaced relative to the second transverse axis 16 that is perpendicular to the longitudinal axis 12. In some aspects, the plurality of columns 408 can be spaced across the inner surface of the inner surfaces 42A,42B of the crown portions 34A,34B. Optionally, for example, one or more columns 408 (e.g., two columns) can be positioned on each side of each medial edge 74A,74B.

As stated herein, it is contemplated that wear-resistant members are known to inhibit cutting efficiency and are, therefore, not conventionally positioned near the cutting face(s) of the crown. However, selective positioning of wear-resistant members at or proximate to the cutting face(s)

of the crown as disclosed herein can compensate for the varying surface velocity, thereby making the wear of the bit across the cutting face(s) considerably less pronounced (e.g., less concave) near the longitudinal axis and extending the life of the drill bit 10.

In various aspects, the drill bit can comprise a plurality of wear resistant members 420 that define at least a portion of the outer surface, a plurality of wear resistant members 402 that define at least a portion of the inner surface of each crown portion and a plurality of wear-resistant members 440 that define at least a portion of the base surface.

Although embodiments are disclosed with general reference to the drill bit 10, it is contemplated that the included wear-resistant members 402 can beneficially be included in the drill bit 200 as well as various other drill bits. For example, drill bits having only a single crown portion can advantageously include the wear-resistant members 402 that reinforce the cutting face as disclosed herein. In these aspects, U.S. Pat. No. 9,279,292 to Pearce et al., which is incorporated by reference herein in its entirety, discloses drill bits, each having a single crown portion, and wear resistant members 402 as described herein can be incorporated to extend the life of such bits.

In further aspects, wear-resistant members 402 can be positioned within coring drill bits. For example, referring to FIGS. 24-26, a bit 450 can include a shank 452 and a crown portion 454 defining a cutting face 456. The crown 454 can have a generally annular shape defined by an inner surface 460 and an outer surface 462. The crown 454 can thus define a space 464 about a central axis 466 for receiving a core sample.

The bit 450 can comprise one or a plurality of wear-resistant members 402. In some aspects, the wear-resistant members 402 can be positioned within 0.25 inches, within 0.2 inches, within 0.15 inches, within 0.10 inches, or within 0.05 inches from the cutting face 456 of the bit.

Optionally, the crown 454 can define waterways 470 that extend between the inner surface 460 and the outer surface 462. Optionally, at least a portion of the waterways can be positioned at the face of the drill bit such that the waterways are axially recessed from the drill bit face. In further optional aspects, at least a portion of the waterways can be provided as enclosed slots (i.e., slots that are fully enclosed by the drill bit matrix) that are axially spaced from the face of the bit. In these aspects, the matrix of the bit can wear down such that the slots are eventually positioned at the operative face of the drill bit. In further aspects, it is contemplated that multiple rows (e.g., circumferentially staggered rows) of enclosed slots are axially spaced within the drill bit, thereby providing at least some waterways at the face of the drill bit throughout the cutting life of the bit.

Optionally, the waterways 470 can be axially tapered. That is, the cross sectional area of the waterways 470, in planes that are perpendicular to respective axes that extend from the central axis 466 and through the waterways, can decrease in the direction toward the central axis 466. The waterways 470 can have a first side surface 472 and a second side surface 474. Optionally, the first side surface 472 can be parallel to a plane that includes the central axis 466 and intersects the waterway 470 between the first and second side surfaces 472, 474, and the second side surface 474 can be skew to the plane that includes the central axis 466. In these optional aspects, it is contemplated that the circumferential width of the waterway 470 (measured at a given radius from the central axis) can decrease in the direction toward the central axis (as the radius decreases). In this way, it is contemplated that the waterways 470 can optionally have a radial taper. Optionally, it is further contemplated that the waterways 470 can have both an axial taper and a radial taper. In operation, it is contemplated that the axial and/or radial tapering of the waterways as disclosed herein can promote the flow of fluid away from the cutting face by providing an increase in the operative area and volume of the waterways in a direction moving away from the central axis.

In some aspects, at least a portion of the plurality of wear resistant members 402 can be configured to reinforce the second side surface 474 of each waterway 470. For example, at least one (optionally, two) wear resistant members 402 can be positioned against the inner surface 460 of the crown proximate to where the inner surface 460 intersects the second surface 474 of each waterway 470. Similarly, at least one (optionally, two) wear resistant members 402 can be positioned against the outer surface 462 of the crown proximate to where the inner surface 460 intersects the second surface 474 of each waterway 470. It is contemplated that the bit can rotate clockwise so that the second surface 474 can correspond to the leading surface of the bit as the bit rotates clockwise. Accordingly, axially extending edges where the inner and outer surfaces 460, 462 intersect the second surface 474 can be subject to relatively greater wear. Accordingly, the wear resistant members 402 positioned at or proximate to said axially extending edges can be configured to reinforce said axially extending edges to inhibit chipping or other wearing. Optionally, the number of wear resistant members 402 (e.g., two or more wear resistant members) at the outer surface 462 can be equal to the number of wear resistant members at the inner surface 460. Alternatively, the number of wear resistant members 402 (e.g., two or more wear resistant members) at the outer surface 462 can be greater or less than the number of wear resistant members at the inner surface 460. Optionally, the sizes of the wear resistant members 402 at the outer surface 462 can be equal or substantially equal to the sizes of the wear resistant members at the inner surface 460. Alternatively, the sizes of the wear resistant members 402 at the outer surface 462 can be substantially different than the sizes of the wear resistant members at the inner surface 460.

Figure 26:
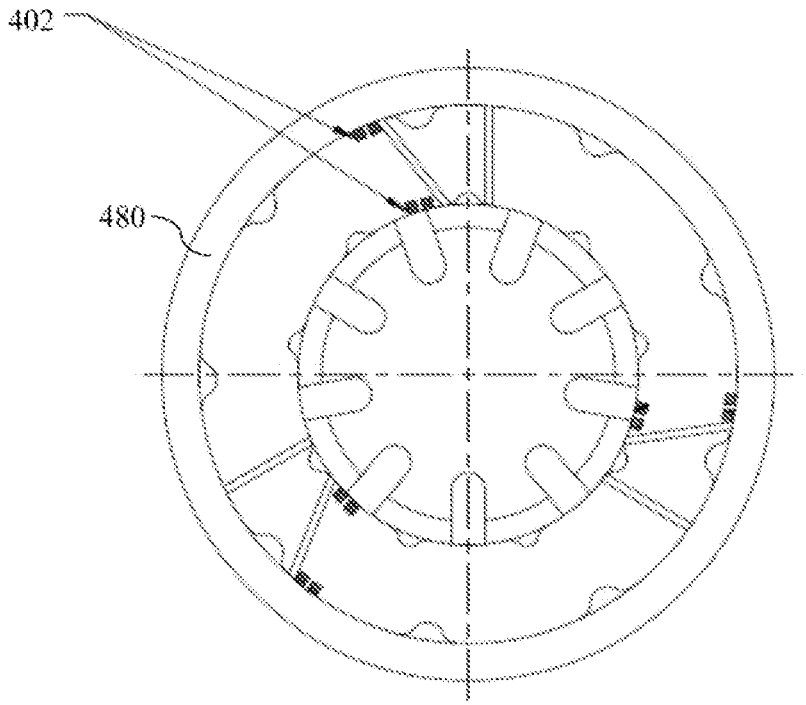
FIG. 26 is a mold for forming at least a portion of the drill bit of FIG. 24, with reinforcement members provide therein.

FIG. 26 illustrates a mold 480 having wear resistant members 402 positioned for forming a bit 450 in accordance with embodiments disclosed herein.

Further aspects of core drilling bits in accordance with embodiments disclosed herein are provided in U.S. Pat. No. 9,500,036, granted Nov. 22, 2016, which is hereby incorporated by reference herein.

Drilling Systems

Figure 20:
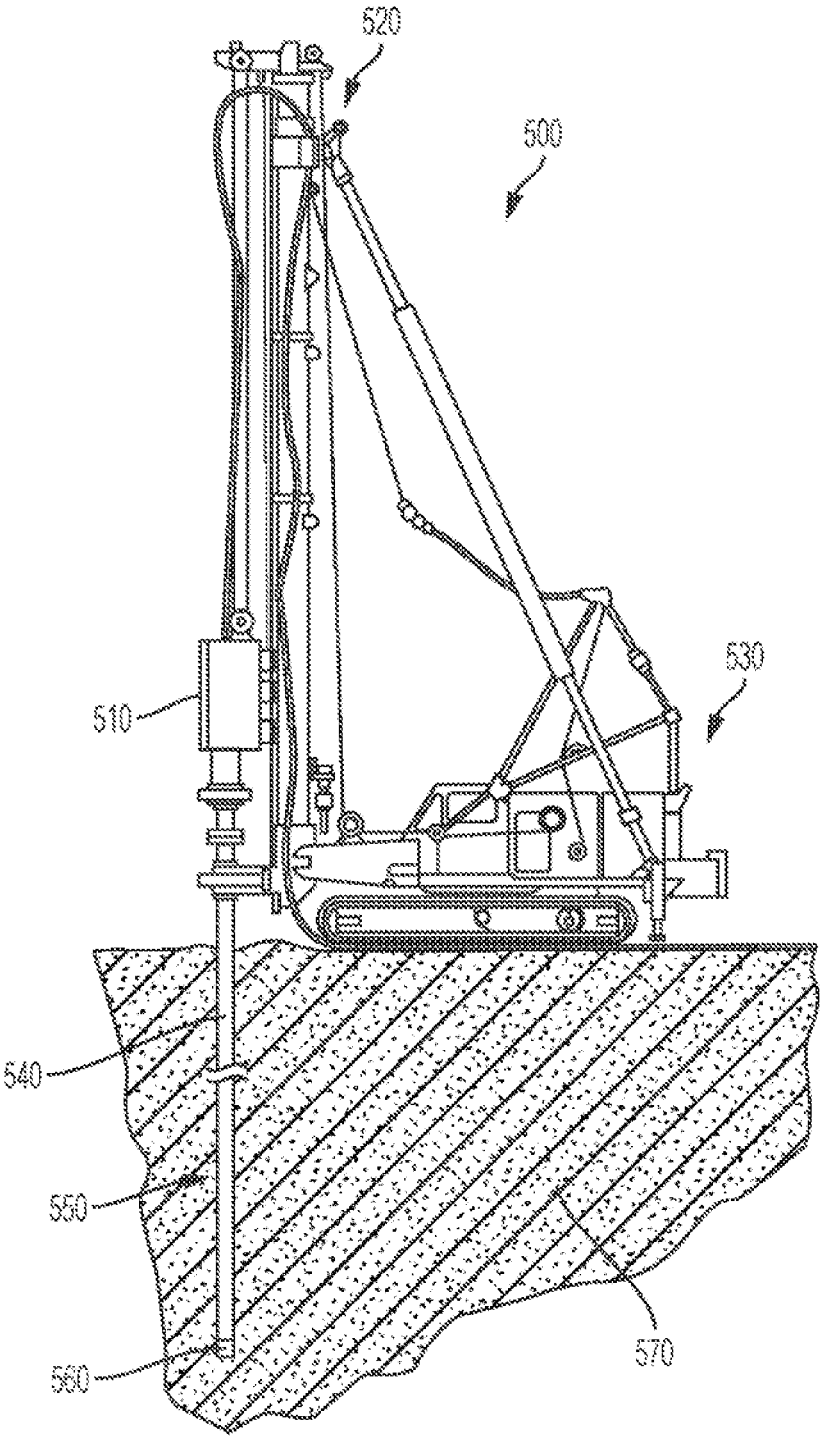
FIG. 20 depicts an exemplary drilling system comprising a drill bit as disclosed herein.

In exemplary aspects, and with reference to FIG. 20, the drill bits disclosed herein can be provided as part of a drilling system 500. In these aspects, it is contemplated that the drilling system 500 can comprise a drill head 510, a mast 520, a drill rig 530, and a drill string 550 configured to be secured to and rotated by the drill rig, as are conventionally known in the art. The drill string 550 can comprise a plurality of drill rods 540. It is further contemplated that a drill bit 560 can be operatively coupled to an end of the drill string 550. For example, it is contemplated that the drill bits 10, 200, as disclosed herein, can be coupled to the drill string 550 via a threaded coupling. In operation, as the drill string 550 is rotated and pushed by the drill rig 530, it is contemplated that the drill bit 560 (corresponding to a drill bit 10, 200 as disclosed herein) can grind away materials in a formation 570. The drill bit 560 can be advanced into the formation to form a borehole. The drill bit 560 can form cuttings. Optionally, fluid can be pumped down the borehole to flush the cuttings from the borehole as well as to cool the drill bit.

Alternatively, in other exemplary aspects, the drilling system 500 can comprise a down-hole motor in place of, or in addition to, the drill head 510 and drill rig 530. In these aspects, it is contemplated that the down-hole motor can be operatively coupled to the drill string and drill bit 560 in a conventional manner. As one will appreciate, it is contemplated that such a down-hole motor can permit selective adjustment (i.e., reversal) of the direction of rotation of the drill bit.

In use, it is contemplated that the drill bits (e.g., full face drill bits) disclosed herein can achieve desired penetration levels at lower levels of thrust than are required with known drill bits. Due to the increased strength and flushing of the drill bits disclosed herein, it is contemplated that the disclosed drill bits can show less wear and have an increased functional product life compared to known drill bits, with the drill bits disclosed herein having a functional product life of up to about 5 times greater than the functional product life of known bits. It is further contemplated that the increased strength and flushing of the disclosed drill bits can permit the use of greater depths for diamond impregnation during manufacturing. It is still further contemplated that the disclosed drill bits can produce higher fluid velocity at the cutting face, thereby providing faster rock removal and heat transfer and limiting wear of the diamonds within the bit, which are typically worn due to the high heat and friction of the rock.

Various exemplary features of drill bits in accordance with embodiments herein are disclosed in U.S. Pat. No. 10,077,609 granted Sep. 18, 2018, and 9,279,292, granted Mar. 8, 2016, which are hereby incorporated by reference in their respective entireties.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill bit for cutting a hole in a formation, the drill bit having a longitudinal axis extending along a center of the drill bit, the drill bit comprising: a crown comprising at least one crown portion having a cutting face; and a plurality of wear-resistant members embedded in the crown of the drill bit, wherein at least one wear-resistant member of the plurality of wear-resistant members extends to within 0.1 inches of the cutting face of the at least one crown portion.

Aspect 2: The drill bit of aspect 1, wherein at least one wear-resistant member of the plurality of wear-resistant members extends to the cutting face of the at least one crown portion.

Aspect 3: The drill bit of any one of the preceding aspects, wherein the at least one wear resistant member that extends to within 0.1 inches of the cutting face of the at least one crown portion comprises a plurality of wear-resistant members that extend to within 0.1 inches of the cutting face of the at least one crown portion.

Aspect 4: The drill bit of any one of the preceding aspects, wherein each wear resistant member of the plurality of wear resistant members is elongate relative to respective longitudinal axes, wherein the respective longitudinal axes of the plurality of wear resistant members are generally parallel to the longitudinal axis of the drill bit.

Aspect 5: The drill bit of aspect 3, wherein none of the plurality of wear resistant members that extend to within 0.1 inches of the cutting face of the at least one crown portion are positioned outside of a radius of ½ inch from the longitudinal axis of the drill bit.

Aspect 6: The drill bit of any one of the preceding aspects, wherein the plurality of wear-resistant members comprise thermally stable diamond (TSD) pins.

Aspect 7: The drill bit of aspect 6, wherein the TDS pins have dimensions of 1.5 mm×1.5 mm×5 mm.

Aspect 8: The drill bit of any one of the preceding aspects, wherein the plurality of wear resistant members comprise a plurality of rows of wear resistant members that are spaced along the longitudinal axis.

Aspect 9: The drill bit of aspect 8, wherein the plurality of rows comprises three rows.

Aspect 10: The drill bit of any one of the preceding aspects, wherein the plurality of wear resistant members comprise a plurality of columns that are spaced relative to a transverse axis.

Aspect 11: The drill bit of any one of the preceding aspects, further comprising:

a shank, wherein the at least one crown portion comprises a plurality of crown portions spaced apart relative to the operative circumference of the crown, wherein each crown portion of the plurality of crown portions further has:

a first longitudinal edge;

a second longitudinal edge;

an outer surface that extends between the first longitudinal edge and the second longitudinal edge and defines a portion of the operative circumference of the crown; and at least one inner surface, wherein the at least one inner surface extends from the first longitudinal edge to the second longitudinal edge; and a base surface spaced from the cutting faces of the plurality of crown portions relative to the longitudinal axis of the drill bit, wherein the base surface cooperates with the inner surfaces of the plurality of crown portions to define a slot, and wherein the crown and the shank cooperate to define an interior space about the longitudinal axis.

Aspect 12: The drill bit of aspect 11, wherein at least a portion of the plurality of wear resistant members at least partially define the inner surfaces of the plurality of crown portions.

Aspect 13: The drill bit of aspect 11 or aspect 12, wherein at least a portion of the plurality of wear resistant members at least partially define the slot.

Aspect 14: The drill bit of any one of aspects 11-13, wherein the plurality of crown portions comprises first and second crown portions spaced apart relative to a first transverse axis that is perpendicular to the longitudinal axis.

Aspect 15: The drill bit of any one of aspects 11-14, further comprising a plurality of bores defined within each of the first and second crown portions that extend from the cutting face of each of the first and second crown portions to the interior space.

Aspect 16: The drill bit of any one of aspects 11-15, further comprising a plurality of projections defined within each of the first and second crown portions that extend outwardly from the cutting face of each of the first and second crown portions relative to the longitudinal axis of the drill bit.

Aspect 17: The drill bit of any one of aspects 11-16, wherein each of the first and second crown portions does not comprise a waterway extending radially between the outer surfaces of the first and second crown portions and the interior space.

Aspect 18: The drill bit of any one of aspects 11-17, wherein the outer surfaces of the first and second crown portions respectively define a plurality of channels extending radially inwardly toward the longitudinal axis.

Aspect 19: The drill bit of any one of aspects 12-18, wherein each channel of the plurality of channels of the first crown portion has a width, wherein each channel of the plurality of channels of the second crown portion has a width, wherein the width of each channel of the first crown portion decreases from the outer surface of the first crown portion moving radially inwardly toward the longitudinal axis, and wherein the width of each channel of the second crown portion decreases from the outer surface of the second crown portion moving radially inwardly toward the longitudinal axis.

Aspect 20: The drill bit of any one of aspects 11-19, wherein the plurality of channels of the first crown portion comprise a first plurality of channels having a first size and a second plurality of channels having a second size, wherein the plurality of channels of the second crown portion comprise a first plurality of channels having the first size and a second plurality of channels having the second size, and wherein the second size is larger than the first size.

Aspect 21: The drill bit of aspect 20, wherein at least one channel of the first plurality of channels of the first crown portion is positioned circumferentially between sequential channels of the second plurality of channels of the first crown portion, and wherein at least one channel of the first plurality of channels of the second crown portion is positioned circumferentially between sequential channels of the second plurality of channels of the second crown portion.

Aspect 22: The drill bit of aspect 21, wherein each channel of the first plurality of channels of the first and second crown portions has a first radial length, wherein each channel of the second plurality of channels of the first and second crown portions has a second radial length, and wherein the second radial length is greater than the first radial length.

Aspect 23: The drill bit of any one of aspects 11-22, wherein the at least one inner surface comprises a plurality of inner surfaces.

Aspect 24: The drill bit of any one of aspects 11-23, wherein the at least one inner surface of each of the first and second crown portions comprises a first inner surface, a second inner surface, and a longitudinal medial edge, wherein the first inner surface extends from the first edge of the crown portion to the longitudinal medial edge of the crown portion, wherein the second inner surface extends from the second edge of the crown portion to the longitudinal medial edge.

Aspect 25: The drill bit of aspect 24, wherein the plurality of wear resistant members are arranged in a plurality of columns, wherein the plurality of columns comprises, along each of the first and second inner surfaces, at least two column positioned on each side of the respective first and second medial edge.

Aspect 26: The drill bit of aspect 24 or aspect 25, wherein the first inner surface and the second inner surface of the first crown portion are angularly oriented relative to each other at a first desired angle, wherein the first inner surface and the second inner surface of the second crown portion are angularly oriented relative to each other at a second desired angle, and wherein the first desired angle is substantially equal to the second desired angle.

Aspect 27: The drill bit of aspect 26, wherein the first and second desired angles range from about 135 degrees to about 225 degrees.

Aspect 28: The drill bit of aspect 25, wherein the first inner surface and the second inner surface of the first crown portion are angularly oriented relative to each other at a first desired angle, wherein the first inner surface and the second inner surface of the second crown portion are angularly oriented relative to each other at a second desired angle, and wherein the first desired angle is different than the second desired angle.

Aspect 29: The drill bit of aspect 26, wherein the first and second desired angles range from about 135 degrees to about 225 degrees.

Aspect 30: The drill bit of any one of aspects 24-29, wherein the first inner surfaces of the first and second crown portions have respective lengths corresponding to the distance between the first longitudinal edge and the longitudinal medial edge of the crown portion, and wherein the length of the first inner surface of the first crown portion is not equal to the length of the first inner surface of the second crown portion.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A drill bit for cutting a hole in a formation, the drill bit having a longitudinal axis extending along a center of the drill bit, the drill bit comprising:

a crown comprising a plurality of crown portions that have respective cutting faces positioned at a common axial position along the longitudinal axis of the drill bit; and a plurality of wear-resistant members embedded in the crown of the drill bit, wherein a distal-most surface of at least one wear-resistant member of the plurality of wear-resistant members extends to within 0.1 inches of the cutting face of at least one crown portion of the plurality of crown portions, wherein the crown comprises a matrix impregnated with diamonds, wherein the matrix is configured to wear to expose the diamonds, and wherein each wear-resistant member having a distal-most surface that extends to within 0.1 inches of the cutting face is positioned entirely within a radius of 1 inch from the longitudinal axis of the drill bit.

2. The drill bit of claim 1, wherein the at least one wear-resistant member of the plurality of wear-resistant members extends to the cutting face of the at least one crown portion of the plurality of crown portions.

3. The drill bit of claim 1, wherein the at least one wear-resistant member that extends to within 0.1 inches of the cutting face of the at least one crown portion of the plurality of crown portions comprises a plurality of wear-resistant members that extend to within 0.1 inches of the cutting face of the at least one crown portion of the plurality of crown portions.

4. The drill bit of claim 1, wherein each wear-resistant member of the plurality of wear-resistant members is elongate relative to respective longitudinal axes, wherein the respective longitudinal axes of the plurality of wear-resistant members are generally parallel to the longitudinal axis of the drill bit.

5. The drill bit of claim 1, wherein none of the plurality of wear-resistant members that extend to within 0.1 inches of the cutting face of the at least one crown portion of the plurality of crown portions are positioned outside of a radius of ½ inch from the longitudinal axis of the drill bit.

6. The drill bit of claim 1, wherein the plurality of wear-resistant members comprise thermally stable diamond (TSD) pins.

7. The drill bit of claim 1, wherein the plurality of wear-resistant members comprise a plurality of rows of wear-resistant members that are spaced along the longitudinal axis.

8. The drill bit claim 1, wherein the plurality of wear-resistant members comprise a plurality of columns that are spaced relative to a transverse axis.

9. The drill bit of claim 1, further comprising:

a shank, wherein the plurality of crown portions are spaced apart relative to the operative circumference of the crown, wherein each crown portion of the plurality of crown portions further has:

a first longitudinal edge;

a second longitudinal edge;

an outer surface that extends between the first longitudinal edge and the second longitudinal edge and defines a portion of the operative circumference of the crown; and at least one inner surface, wherein the at least one inner surface extends from the first longitudinal edge to the second longitudinal edge; and a base surface spaced from the cutting faces of the plurality of crown portions relative to the longitudinal axis of the drill bit, wherein the base surface cooperates with the inner surfaces of the plurality of crown portions to define a slot, and wherein the crown and the shank cooperate to define an interior space about the longitudinal axis.

10. The drill bit of claim 9, wherein at least a portion of the plurality of wear-resistant members at least partially define the inner surfaces of the plurality of crown portions.

11. The drill bit of claim 9, wherein at least a portion of the plurality of wear-resistant members at least partially define the slot.

12. The drill bit of claim 9, wherein the plurality of crown portions comprises first and second crown portions spaced apart relative to a first transverse axis that is perpendicular to the longitudinal axis.

13. The drill bit of claim 12, wherein each of the first and second crown portions does not comprise a waterway extending radially between the outer surfaces of the first and second crown portions and the interior space.

14. The drill bit of claim 12, wherein the at least one inner surface of each of the first and second crown portions comprises a first inner surface, a second inner surface, and a longitudinal medial edge, wherein the first inner surface extends from the first edge of the crown portion to the longitudinal medial edge of the crown portion, wherein the second inner surface extends from the second edge of the crown portion to the longitudinal medial edge.

15. The drill bit of claim 14, wherein the plurality of wear-resistant members are arranged in a plurality of columns, wherein the plurality of columns comprises, along each of the first and second inner surfaces, at least two columns positioned on each side of the respective first and second medial edge, wherein the at least one wear-resistant member of the plurality of wear-resistant members that extends to within 0.1 inches of the cutting face of the at least one crown portion of the plurality of crown portions comprises a respective wear-resistant member of each column of the at least two columns positioned on each side of the respective first and second medial edge.

16. The drill bit of claim 9, wherein the outer surfaces of the first and second crown portions respectively define a plurality of channels extending radially inwardly toward the longitudinal axis, wherein each channel of the plurality of channels has a leading edge and a trailing edge, wherein at least one wear-resistant member of the plurality of wear-resistant members is positioned at the leading edge of each channel of the plurality of channels.

17. The drill bit of claim 1, wherein the respective cutting faces of the plurality of crown portions are planar.

18. The drill bit of claim 17, further comprising at least one of:

a plurality of projections extending outwardly from each cutting face of the plurality of crown portions; or at least one circumferentially extending groove extending inwardly into each cutting face of the plurality of crown portions, wherein the at least one circumferentially extending groove is centered about the longitudinal axis of the drill bit.

* * * * *